US012232620B2

(12) United States Patent
Doyon

(10) Patent No.: US 12,232,620 B2
(45) Date of Patent: Feb. 25, 2025

(54) POLYVALENT FOLDING CHAIR WITH COUNTERWEIGHT

(71) Applicant: SIÈGES DUCHARME INTERNATIONAL (1991) INC., Montreal (CA)

(72) Inventor: Jean-Christophe Doyon, Terrebonne (CA)

(73) Assignee: SIÈGES DUCHARME INTERNATIONAL (1991) INC., Montreal (CA)

( * ) Notice: Subject to any disclaimer, the term of this patent is extended or adjusted under 35 U.S.C. 154(b) by 0 days.

(21) Appl. No.: 18/653,626

(22) Filed: May 2, 2024

(65) Prior Publication Data

US 2024/0365981 A1 Nov. 7, 2024

Related U.S. Application Data

(60) Provisional application No. 63/463,328, filed on May 2, 2023.

(51) Int. Cl.

| | |
|---|---|
| ***A47C 1/121*** | (2006.01) |
| ***A47C 4/10*** | (2006.01) |
| ***A47C 4/14*** | (2006.01) |
| ***A47C 4/20*** | (2006.01) |
| ***A47C 4/44*** | (2006.01) |

(52) U.S. Cl.

CPC ..... *A47C 1/121* (2013.01); *A47C 4/10* (2013.01); *A47C 4/14* (2013.01); *A47C 4/20* (2013.01); *A47C 4/44* (2013.01)

(58) Field of Classification Search

CPC ..... A47C 1/121

USPC ..... 297/23, 56, 332

See application file for complete search history.

(56) References Cited

U.S. PATENT DOCUMENTS 400,183 A * 3/1889 Blake ..... A47C 7/56 297/332

565,807 A * 8/1896 Von Spitzingen ..... A47C 7/56 297/332

(Continued)

FOREIGN PATENT DOCUMENTS

CA 2465896 5/2003

FR 3136946 A1 * 12/2023

(Continued)

OTHER PUBLICATIONS 15 page PDF of a machine generated translation of JP2001149180A. (Year: 2001).*

*Primary Examiner* — Robert Canfield

(74) *Attorney, Agent, or Firm* — Benoit&Cote Inc.; Mathieu Audet

(57) ABSTRACT

A folding chair has a front leg assembly and a rear leg assembly rotatably mounted to the front leg assembly, the rear leg assembly foldable between an unfold extended configuration and a folded compact configuration wherein the rear leg assembly extends about parallel to the front leg assembly. The folding chair has a backrest mounted to the front leg assembly. The folding chair has a seat rotatably mounted to the front seat assembly, the seat being movable between a seating position and an upright position. The hair has a counterweight and damping components damping the pivotal motion of the seat when reaching the seating position and the upright position.

20 Claims, 41 Drawing Sheets

(56) References Cited

U.S. PATENT DOCUMENTS

| | | | | |
|---|---|---|---|---|
| 1,210,518 | A * | 1/1917 | Nolan | A47C 7/56 297/332 |
| 1,958,061 | A * | 5/1934 | Merrill | A47C 7/58 297/332 |
| 2,001,991 | A * | 5/1935 | Vandervoort | A47C 7/58 297/332 |
| 2,164,116 | A * | 6/1939 | Lincoln | A47C 7/56 5/56 |
| 2,268,914 | A * | 1/1942 | Vandervoort | A47C 7/58 297/332 |
| 3,098,677 | A * | 7/1963 | Williams | A47C 7/58 297/335 |
| 3,464,753 | A * | 9/1969 | Van Ryn | A47C 4/20 52/9 |
| 3,690,726 | A | 9/1972 | Van Ryn | |
| 3,727,975 | A * | 4/1973 | Anderson | A47C 1/121 297/332 |
| 3,982,785 | A | 9/1976 | Ambasz | |
| 4,534,590 | A | 8/1985 | Yamamura et al. | |
| 5,547,257 | A | 8/1996 | Lavender | |
| 6,318,801 | B1 | 11/2001 | Tkafuji | |
| 6,481,789 | B1 * | 11/2002 | Ambasz | A47C 3/045 297/354.11 |
| 6,877,605 | B2 | 4/2005 | Tsai | |
| 6,953,221 | B1 | 10/2005 | Tseng et al. | |
| 7,000,989 | B2 | 2/2006 | Fisher | |
| 7,303,235 | B1 | 12/2007 | Fongers | |
| 7,607,733 | B1 | 10/2009 | Lin et al. | |
| 8,109,564 | B2 | 2/2012 | Lin et al. | |
| 9,295,334 | B2 | 3/2016 | Olarte | |
| 10,064,491 | B2 | 9/2018 | Piretti | |
| 11,464,337 | B1 * | 10/2022 | Olarte | A47C 7/16 |
| 11,666,152 | B2 * | 6/2023 | Hale | A47C 4/24 297/56 |
| 2004/0084943 | A1 * | 5/2004 | Fisher | A47C 1/121 297/335 |
| 2004/0100134 | A1 | 5/2004 | Plant et al. | |
| 2007/0222266 | A1 | 9/2007 | Lucci et al. | |
| 2010/0156156 | A1 | 6/2010 | Smith | |
| 2010/0213745 | A1 * | 8/2010 | Figueras Mitjans | A47C 1/121 297/340 |
| 2010/0231017 | A1 | 9/2010 | Adams | |
| 2011/0024246 | A1 * | 2/2011 | Mitjans | A47C 7/566 188/297 |
| 2011/0187169 | A1 * | 8/2011 | Stewart | A47C 1/12 297/335 |
| 2011/0187170 | A1 * | 8/2011 | Lin | A47C 1/121 297/333 |
| 2012/0187733 | A1 * | 7/2012 | Lin | A47C 4/04 297/332 |
| 2014/0084657 | A1 | 3/2014 | Edwards et al. | |
| 2015/0054322 | A1 | 2/2015 | Jacobs et al. | |
| 2019/0021502 | A1 | 1/2019 | Piretti | |
| 2019/0387884 | A1 | 12/2019 | Jacobs et al. | |
| 2020/0154892 | A1 * | 5/2020 | Olarte | A47C 1/121 |
| 2024/0016294 | A1 * | 1/2024 | Olarte | A47C 7/56 |

FOREIGN PATENT DOCUMENTS

| | | |
|---|---|---|
| GB | 171714 | 11/1921 |
| JP | 2001149180 | 6/2001 |

* cited by examiner

Fig. 2
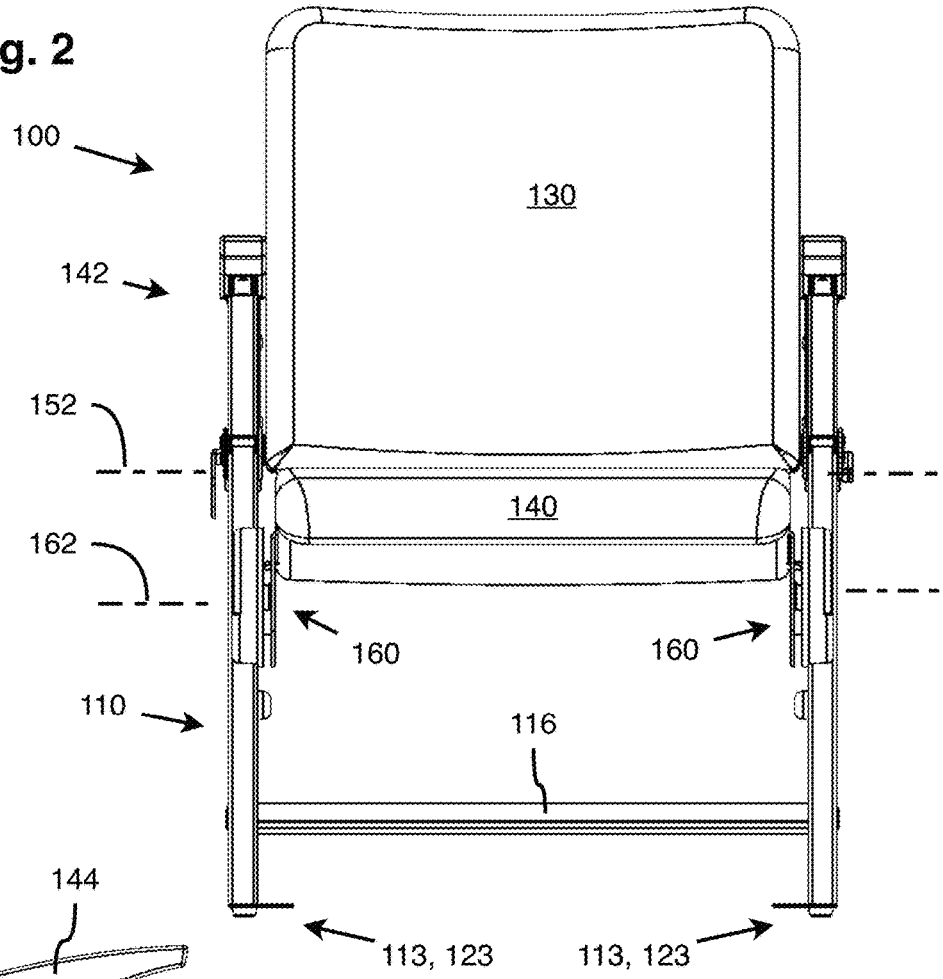
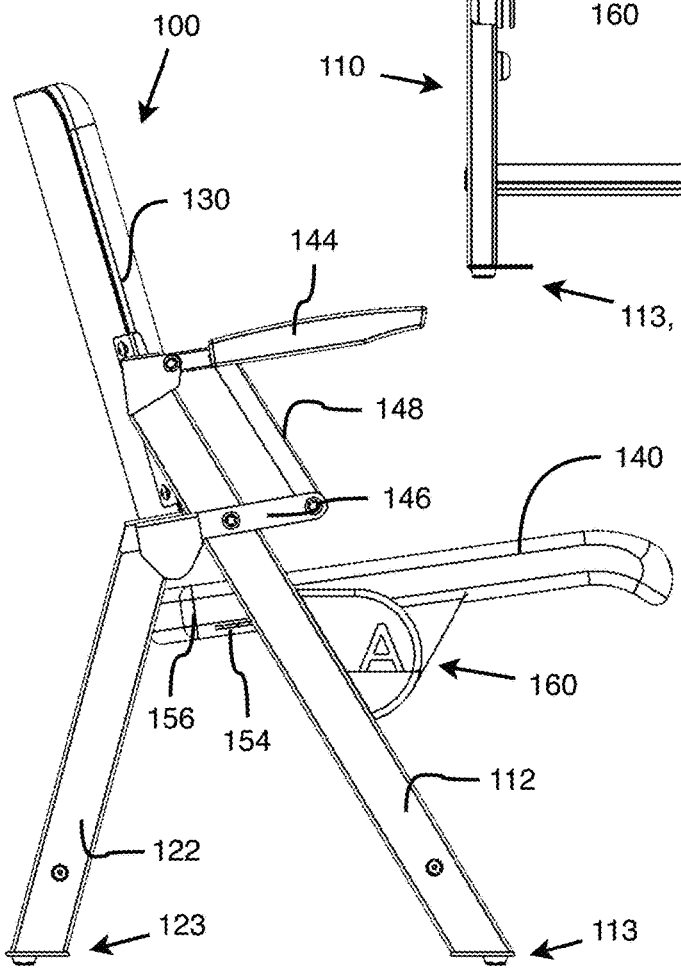
Fig. 3

Fig. 4
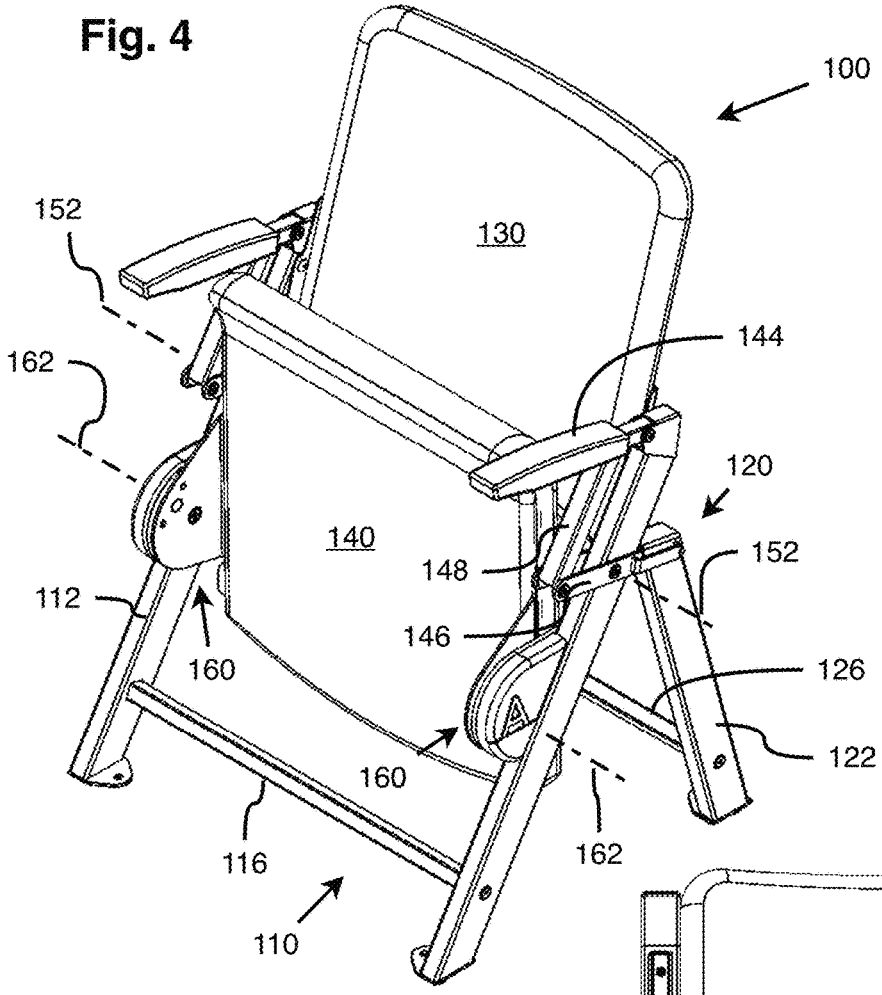
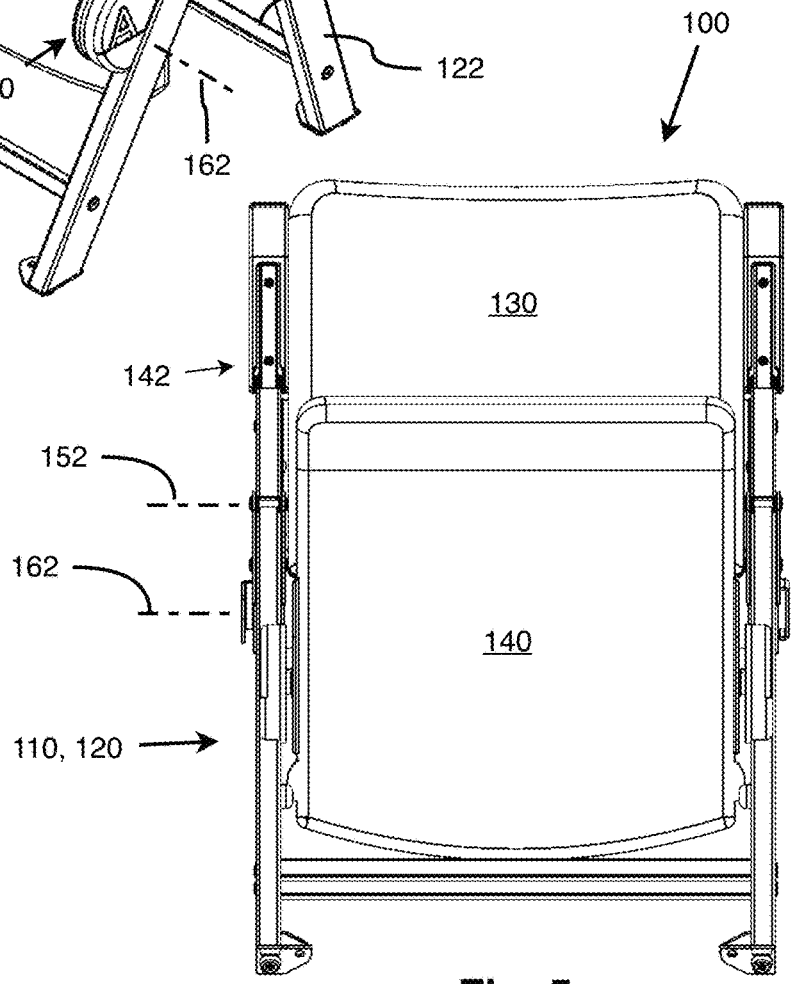
Fig. 5

Fig. 12
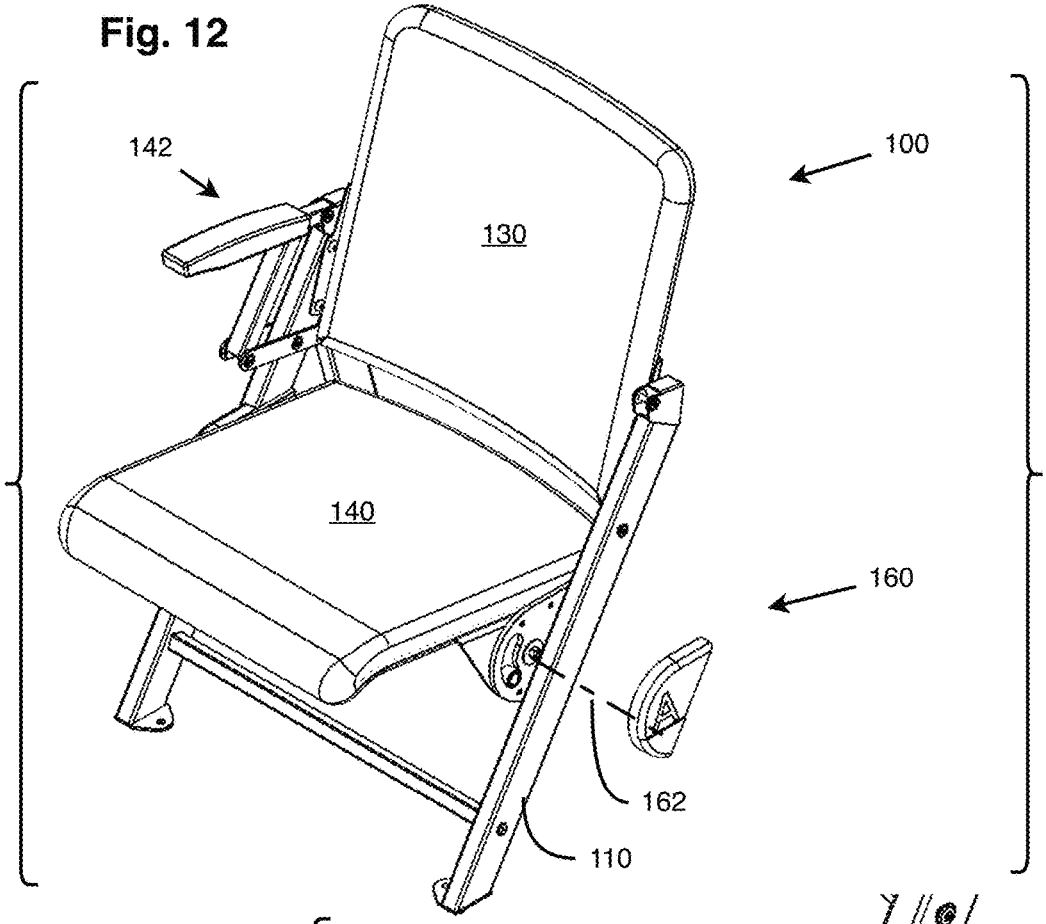
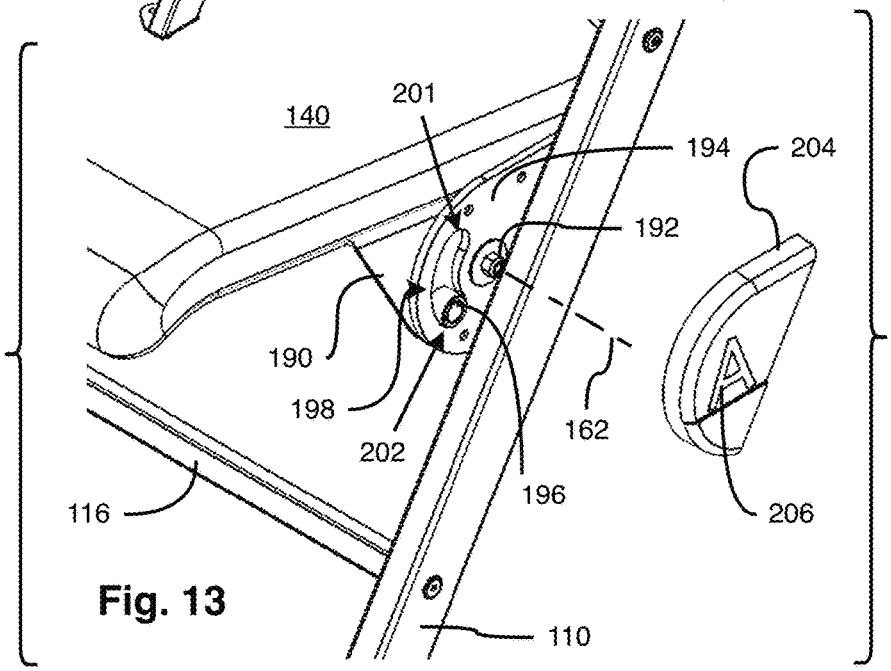
Fig. 13

POLYVALENT FOLDING CHAIR WITH COUNTERWEIGHT

CROSS-REFERENCE TO RELATED APPLICATION

This application relates to and is a non-provisional application claiming priority under 35 U.S.C. § 119 (e) from U.S. provisional patent application Ser. No. 63/463,328, filed Apr. 2, 2023, under 35 U.S.C. § 111, entitled POLYVALENT FOLDING CHAIR WITH COUNTERWEIGHT, the specification of which is hereby incorporated herein by reference in its entirety.

BACKGROUND

(a) Field

The subject matter disclosed generally relates to chairs. More particularly, the subject matter disclosed relates to foldable chairs having a pivoting seat pivoting between a seating position and an upright position.

(b) Related Prior Art

In existing folding chairs, most chairs are adapted to have the seats moving between an upright position and a seating position when unfolding the chairs. Many times, alignment of the system, with time, deteriorates, resulting in the chair becoming more difficult to unfold.

Chairs having an independent pivoting seat are either have the seat returning to the raised position all the time, risking the user missing the seat and falling on the floor, or the seats moving freely, rendering the storing of the chairs more difficult.

There is therefore a need for improved systems to adapt to the seats and allow the seat of a chair to pivot between a seating position and an upright position.

SUMMARY

In some aspects, the description herein relates to a folding chair including a first leg assembly; a second leg assembly rotatably mounted to the first leg assembly, the second leg assembly foldable between a unfolded configuration and a folded configuration in which the second leg assembly extends closer to the first leg assembly; a backrest mounted to the one of the leg assemblies; a pair of seat mounting assemblies, each one of the seat mounting assemblies being mounted to one of the legs of one of the first leg assembly and the second leg assembly; and a seat mounted to the seat mounting assemblies, the seat being rotatable around a seat pivot axis, the seat being movable between a seating position and an upright position, the seat including a counterweight rearward to the seat pivot axis biasing the seat into the upright position, wherein at least one of the seat mounting assemblies includes a first damping means damping rotational motion or pivotal motion of the seat when reaching the upright position.

In some aspects, the description herein relates to a folding chair, wherein the at least one of the seat mounting assemblies includes a pin travelling in a slot, and the first damping means includes a sleeve mounted to the pin that is damping an end of course of the pin into the slot.

In some aspects, the description herein relates to a folding chair, wherein the at least one of the seat mounting assemblies includes a pin travelling in a slot, and the first damping means includes a cushion mounted to one end of the slot.

In some aspects, the description herein relates to a folding chair, wherein the seat mounting assemblies include a plate having a shaft hole; and an arched slot having a center of curvature concentric to the shaft hole.

In some aspects, the description herein relates to a folding chair, wherein the seat mounting assemblies include a bracket coupled to the seat; a shaft extending from the bracket; and a pin extending from the bracket.

In some aspects, the description herein relates to a folding chair, wherein the plate extends parallel to the bracket.

In some aspects, the description herein relates to a folding chair, wherein the plate extends frontwards relative to the leg assemblies.

In some aspects, the description herein relates to a folding chair, wherein the seat mounting assemblies include a cap that is hindering access to the plate from an opposed direction to the bracket.

In some aspects, the description herein relates to a folding chair, wherein the cap covers entirely the slot.

In some aspects, the description herein relates to a folding chair, further including a second damping means that is damping pivotal motion of the seat when reaching the seating position, wherein the first damping means provides more damping than the second damping means.

In some aspects, the description herein relates to a folding chair, wherein the first damping means consists in a sleeve mounted to a pin travelling in a slot between two end-of-course positions, and a cushion mounted to a first one of the end-of-course positions corresponding to the upright position of the seat, thereby providing damping in the seating position of the seat, and a greater damping in the upright position of the seat.

In some aspects, the description herein relates to a folding chair, wherein the seat mounting assemblies include a plate having non-circular shaft hole allowing a shaft to move between aligned to the seat pivot axis and another seat pivot axis, and a slot having two end-of course positions, wherein a first arched section of the slot is centered to the pivot axis, and a second section of the slot is centered to the other pivot axis.

In some aspects, the description herein relates to a folding chair including: a front leg assembly including two front legs; a rear leg assembly including two rear legs, the rear legs being mounted to the front legs, the rear leg assembly foldable between an unfolded configuration and a folded configuration in which the rear leg assembly extends close to the front leg assembly; a backrest mounted to the front leg assembly; a first seat mounting assembly mounted a first one of the front legs; a second seat mounting assembly mounted a second one of the front legs; and a seat mounted to the seat mounting assemblies, the seat being rotatable around a seat pivot axis, the seat being movable between a seating position and an upright position, the seat including a counterweight rearward to the seat pivot axis biasing the seat into the upright position, wherein at least one of the seat mounting assemblies includes a first damping means that is damping pivotal motion of the seat when reaching the upright position.

In some aspects, the description herein relates to a folding chair, wherein each of the seat mounting assemblies includes: a plate that is mounted to the corresponding front leg, the plate including two end-of-course positions; and a bracket that is mounted to the seat and rotatably coupled to the plate, the bracket including a pin travelling between the end-of-course positions when the seat rotates between the seating position and the upright position.

In some aspects, the description herein relates to a folding chair, wherein the pin follows a path between the two end-of-course positions, wherein the path is farther from the front leg than the pivot axis.

In some aspects, the description herein relates to a folding chair, wherein each one of the seat mounting assemblies including a cap that is mounted the to the plate, the cap forming an enclosure to the path.

In some aspects, the description herein relates to a folding chair, wherein the bracket is forming an enclosure impeding access of foreign objects to the path from under the seat.

In some aspects, the description herein relates to a folding chair, wherein at least one of the seat mounting assemblies provides an intermediary position, wherein the seat is biased from the seating position towards the intermediary position, and wherein an external force must be exerted on the seat for the seat to travel beyond the intermediary position.

In some aspects, the description herein relates to a folding chair, wherein the counterweight is enclosed in the seat.

In some aspects, the description herein relates to a folding chair, wherein the pivot axis is upfront and distant to the seat.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIG. 2 is front view of the folding chair of FIG. 1;

FIG. 3 is a side view of the folding chair of FIG. 1;

FIG. 4 is a perspective view of the folding chair of FIG. 1 with the seat in the upright position with the legs in the extended position;

FIG. 5 is a front view of the folding chair of FIG. 4 with the seat in the upright position and the legs in the extended position;

FIG. 12 is a perspective view of the folding chair of FIG. 1 with one rear leg assembly and associated armrest assembly removed, and the cap of the seat mounting assembly on the side spaced apart therefrom;

FIG. 13 is a closeup partial perspective view of components of the folding chair according to depiction of FIG. 12;

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 1:
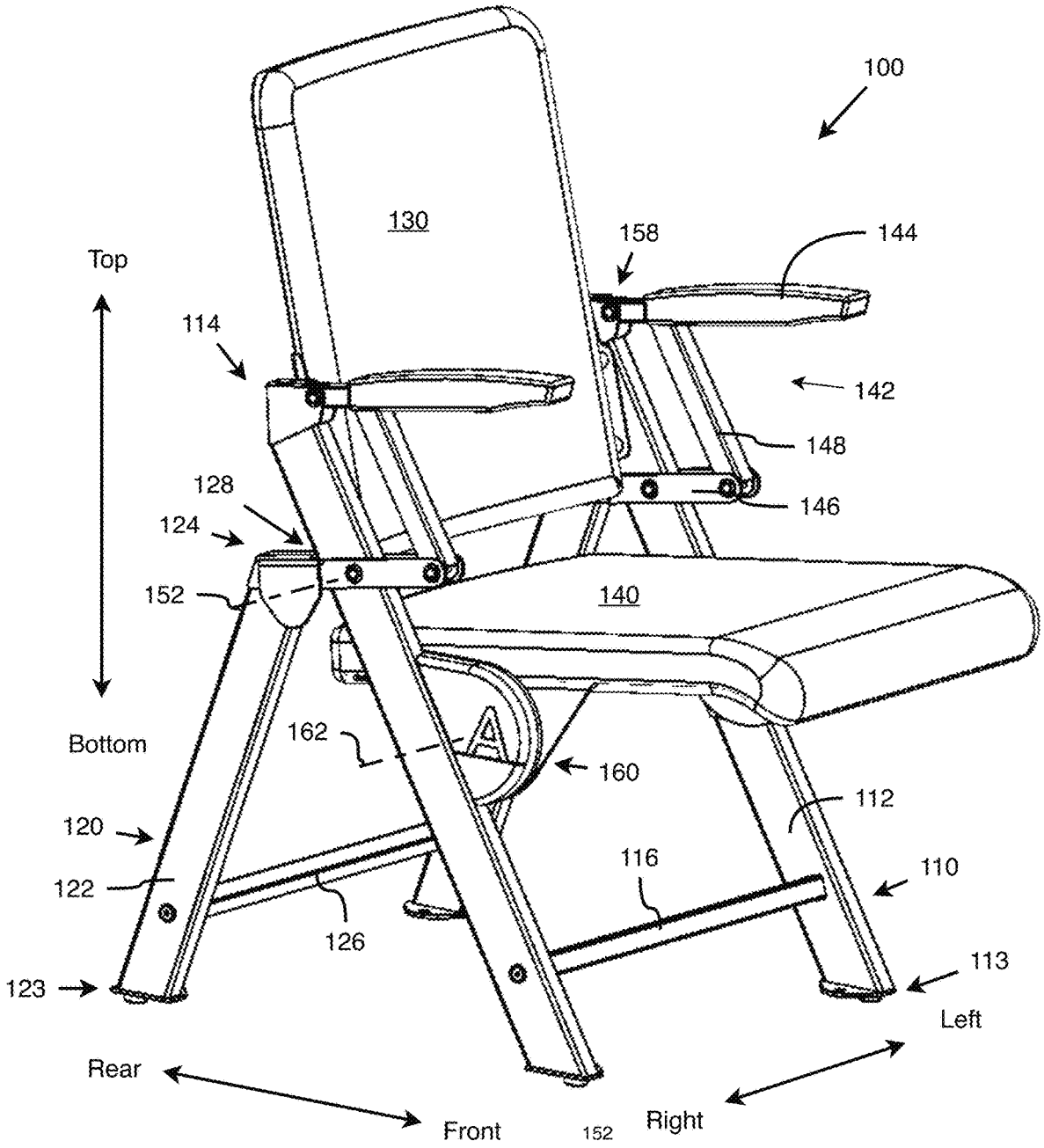
FIG. 1 is a perspective view of a folding chair with the seat in a seating position in accordance with an embodiment.

The terms "left", "right", "front", "rear", "top", "up", "upper", "bottom", "lower", "down", "vertical", "horizontal", "interior" and "exterior" and the like are intended to be construed in their normal meaning in relation with normal usage of the device being described, with spatial references associated with the depiction of FIG. 1. For instance, "rear" is intended to be understood by rear of the chair used in a normal operating configuration for sitting a human being.

The term "floor" means a flat surface where a chair can be installed.

Figure 7:
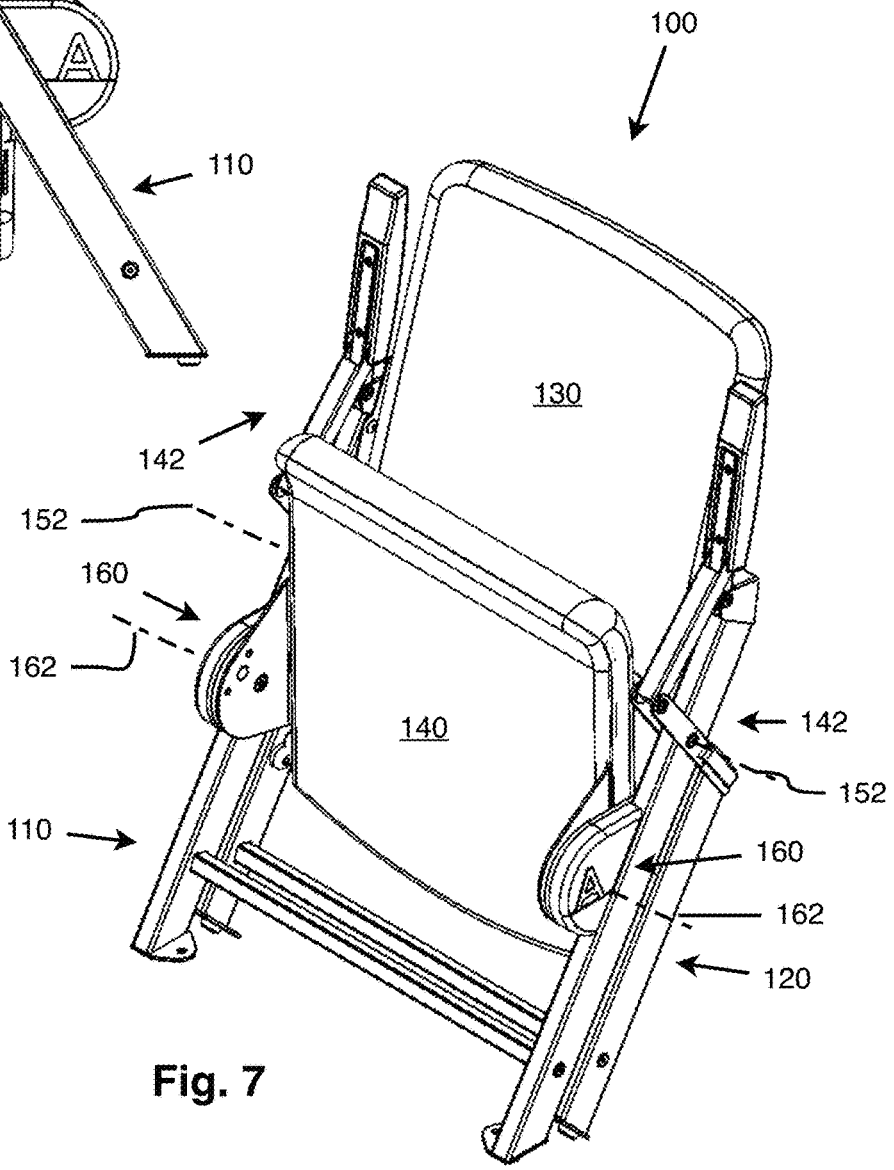
FIG. 7 is a perspective view of the folding chair of FIG. 1 with the seat in the upright position, the arms folded upright, and the legs folded in the collapsed position.

Referring now to the drawings, and more particularly to FIG. 1, FIG. 4, and FIG. 7, a folding chair 100 depicted in FIG. 1 is adapted in an unfolded configuration, with legs extended, to stand on these legs on a floor when about to be used, and, as depicted on FIG. 7, is adapted to take a collapsed configuration with the front legs 112 and the rear legs 122 about parallel to each other, and the seat 140 in the upright position, easing storage of the folding chair 100. When the legs 112, 122 are extended rather than collapsed, the chair 100 may has the seat movable between a biased upright position, see FIG. 4, and a seating position, depicted on FIG. 1.

Referring now on FIGS. 1 to 3, the folding chair 100 comprises a front leg assembly 110, a rear leg assembly 120 rotatably mounted to the front leg assembly 110, a backrest 130 mounted to the front leg assembly 110, and a seat 140 rotatably mounted to the front leg assembly 110 through a seat mounting assembly 160.

The folding chair 100 optionally comprises a pair of armrest assembly 142 rotatably mounted to the front leg assembly 110. The armrest assembly 142 each comprises an armrest 144 rotatably mounted to the front leg assembly 110, a first arm 146 commonly rotatably mounted to the front leg assembly 110, a second arm 148 rotatably mounted to the first arm 146 and to the armrest 144, linking the first arm 146 and the armrest 144. The armrest assemblies 142 though is linking to the rear leg assembly 120, automatically moves between an extended position and a collapsed position when the rear leg assembly 120 is folded along the front leg assembly 110. In the extended position, the armrests 144 extend about parallel to the floor, while in the collapsed position, on FIGS. 7 and 8, the armrests 144 extend along the backrest 130, minimizing the thickness of the folding chair 100, aka the dimension of the folding chair 100 perpendicular to the backrest 130.

Typically, the front leg assembly 110 comprises a pair of front legs 112 designed to extend between a low extremity 113 designed to lay on the floor and a top extremity 114 at least about the height of the rear extremity 158 of the armrest 144, and a transversal bar 116 located about the low extremity 113, improving structural integrity of the front leg assembly 110.

The rear leg assembly 120 comprises a pair of rear legs 122 designed to extend between a low extremity 123 designed to lay on the floor when the rear leg assembly 120 is in the unfolded configuration, and a top extremity 124 joining the first arm 146 about the rotation axis 152, and a transversal bar 126 joining the rear legs 122. The top extremity 124 comprising abutment surfaces 128 designed to butt up against the front legs 112 to maintain the position of the front legs 112 and the rear legs 122 when unfolded, and being able to resist to a person seating on the folding chair 100.

Figure 16:
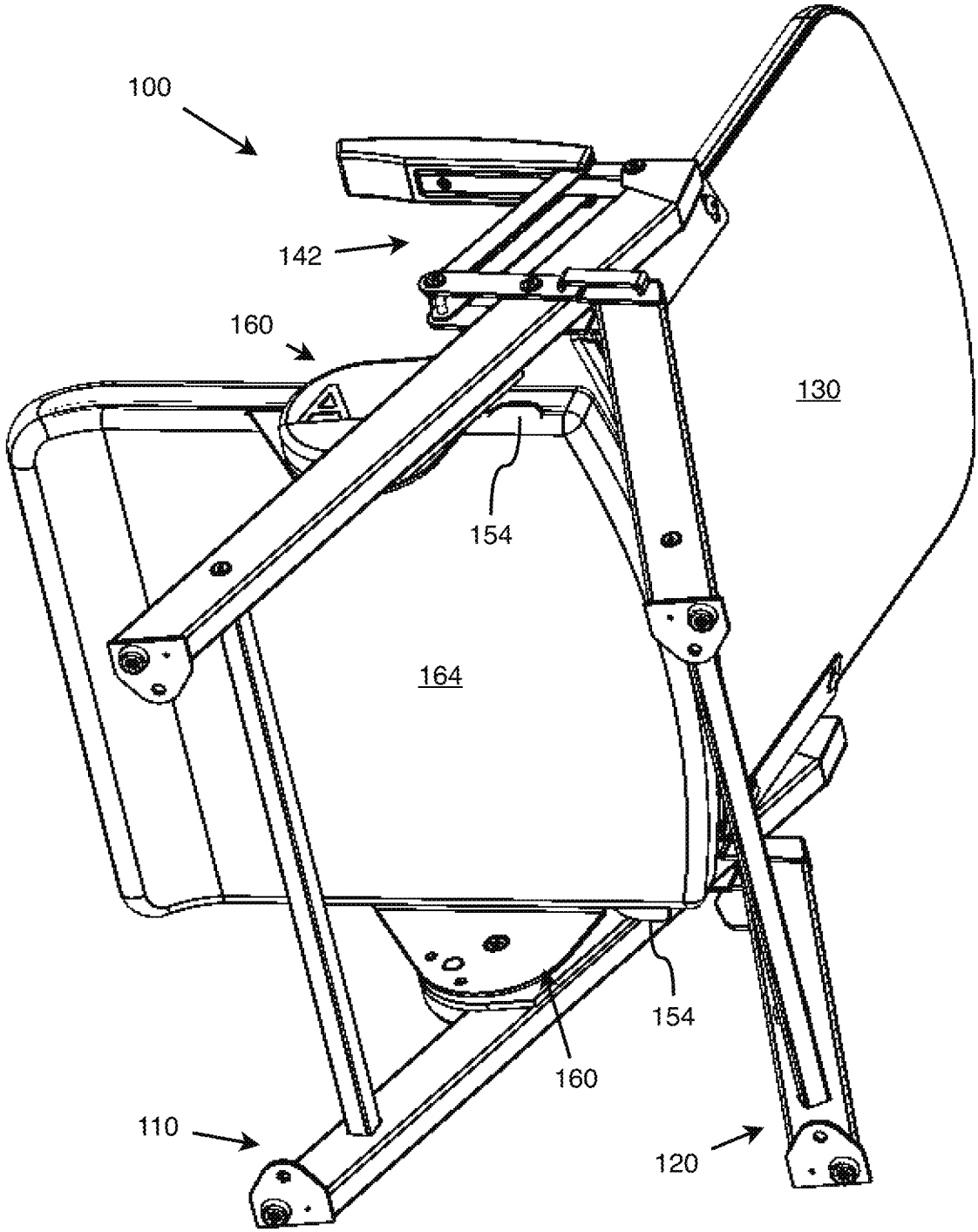
FIG. 16 is a bottom perspective view of the folding chair of FIG. 1 in a seating position in accordance with an embodiment.

Referring additionally to FIG. 16, the seat 140 comprises a tab 154 extending outwardly from the side 156 of the seat 140 rearward from the rotation axis 162 of the seat 140, wherein the tab 154 provides an abutting surface that is designed in position, shape, and length for being pushed by the rear legs 122 toward the front leg assembly 110 when the rear leg assembly 120 adopts a folded configuration, forcing the seat 140 to adopt and remain in the upright position.

In a preferred realization, the seat 140 extends rearward with weight distribution such as being naturally biased toward adopting an upright position.

Figure 15:
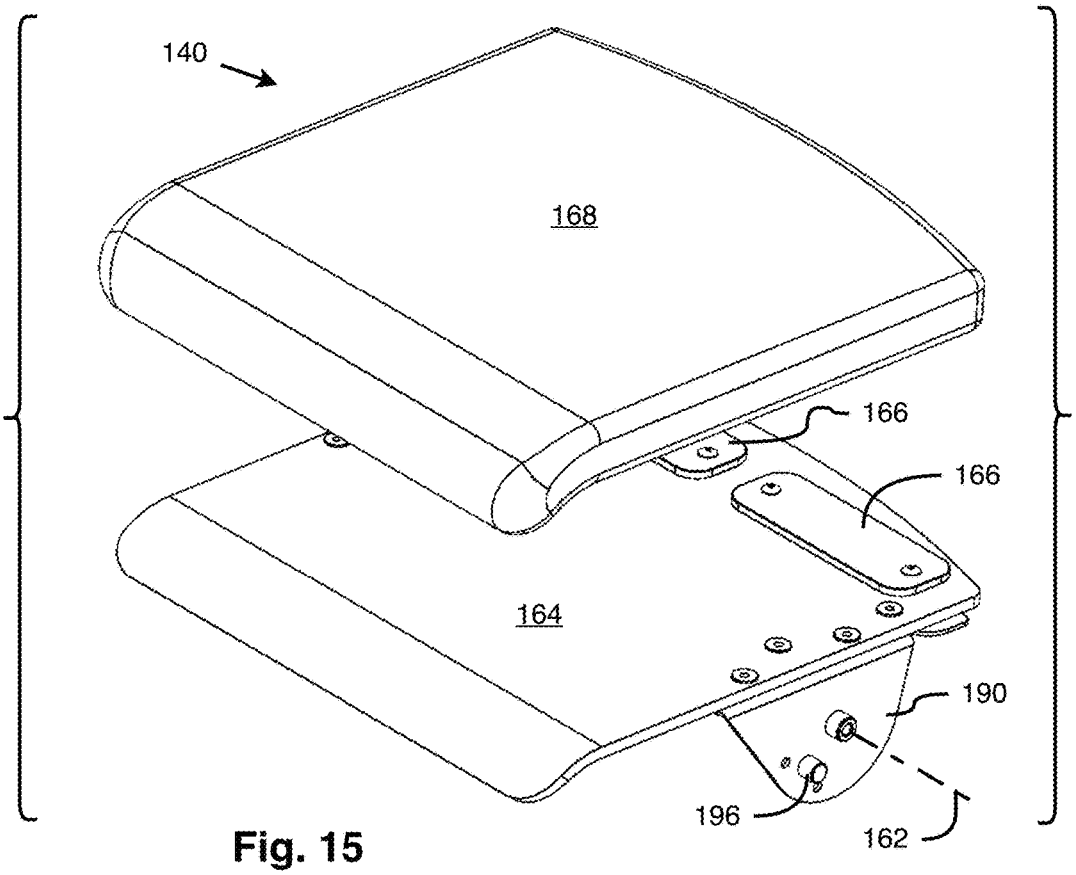
FIG. 15 is an exploded perspective view of a seat with a seat bracket mounted thereto depicting weights mounted to the seat base rearwards to the pivot axis in accordance with an embodiment.

Referring to FIG. 15, in a preferred realization construction of the seat 140 comprises location between the seat base 164 and the seat cushion 168 to install weights 166 rearward to the rotation axis 162, biasing the rear end of the seat 140 downward.

Figure 6:
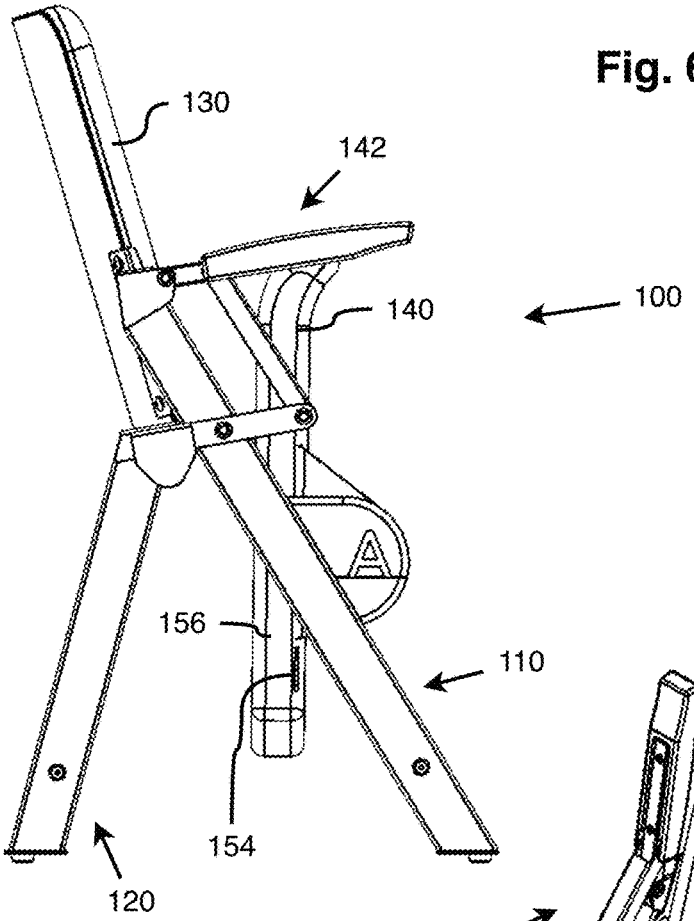
FIG. 6 is a side view of the folding chair of FIG. 4 with the seat in the upright position and the legs in the extended position.

Referring particularly e.g., to FIGS. 6 and 13, it is worth noting that when the legs 112, 122 of the folding chair 100 are in the extended position, the rotation axis 162 is located frontwards to the front legs 112. The seat bracket 190 provides a structure distancing the general body of the seat 140 from the rotation axis 162, and more precisely the tab 154 from the rotation axis 162. Accordingly, the tab 154, being distant from the rotation axis 162 while rotatable concurrently with the seat relatively to the rotation axis 162, is adapted to travel in the space left between the front legs 112 and the rear legs 122. With the action of folding the legs 112, 122 limiting that space, the tab 154 becomes wedged therebetween, with the position of the seat 140 becoming limited also concurrently.

It is further worth noting that this solution limits the odds of someone hitting that component, having their fingers wedged between them and another component of the chair 100, and almost not increasing the weight of the chair 100.

According to an embodiment, the spacing provided by the seat bracket 190 is about the minimal distance of the rotation axis 162 relative to the rear face of the front legs 112.

According to an embodiment, the tab 154 is located about the rearmost limit of the seat 140. The tab 154 is adapted to abut the rear face of the front legs 112 below the closest portion of the rear face relative to the rotation axis 162.

Referring to FIGS. 4 to 6, the folding chair 100 is adapted, when upfolding the rear leg assembly 120, to naturally adopt the depicted configuration with the armrests extended and the seat in the upright position, such configuration being almost ready for someone to sit while relatively compact. When a person desires to sit, the person push the front of the seat frontward and downward until the seat mounting assembly 160 ends the course of the seat 140, depicted on FIG. 1 to FIG. 3, and sits on the seat cushion 168. When the person stands up, the seat 140 free of the weight of the person, is slowly biased back to the upright position.

It is worth noting that providing a counterweight to a chair involves challenges that are more to the scale of the weight and location of the weight on the seat, the use of a counterweight is for the seat to by default adopt an upright position. Adopting an upright position from the seating position involves an acceleration of rotation, or pivotal motion, of the seat up to the upright position, with sudden stop of the seat when reaching the upright position. Such sudden change of speed normally results in pieces hitting and noise that are both undesired or, at least, must be mitigated. Accordingly, having a seat with a counterweight must be accompanied with such solution of mitigation.

Referring additionally to FIG. 12, FIG. 13, and FIG. 15, the seat mounting assembly 160 comprises a pin 196 having an external surface having a low compression ratio. The pin 196 travels in the arched-shaped slot 198 between the first extremity 201 and the second extremity 202 defining end-of-course positions. When the pin 196 hits the second extremity 202, the compression of the exterior surface of the pin 196 slightly damps the end of course of the pin 196 without providing a bumping seat that arises when the damping solution is too strong. At the opposed end, when the pin 196 hits the first extremity 201, the seat 140 rotates at maximum speed and needs to be greatly damped. Accordingly, the seat mounting assembly 160 comprises a damping cushion having a good compression ratio that combined with the pin 196 is damping more efficiently the end of course of the pin 196 in the slot 198. Alternatively, a means for damping could be included in the pivot system to slow down the movement of the seat, preferably at the ends of the pivotal travel. Other means for damping achieving similar results could appear obvious in light of the present description and are considered within the scope of the present invention.

It is further worth noting that the location of the slot 198 distant from the rotation axis 162 allows to have a course of the pin 196 that extends over a substantial distance. It further allows to have the pivot axis 162 close to the front leg assembly 110, with the slot 198 more distant to the front leg assembly 110, providing a robust structure. Such configuration, with the cap 204 mounted thereto and closing the mechanism, provides minimal to no space for fingers or other foreign material to be wedged when the seat is pivoting.

Figure 8:
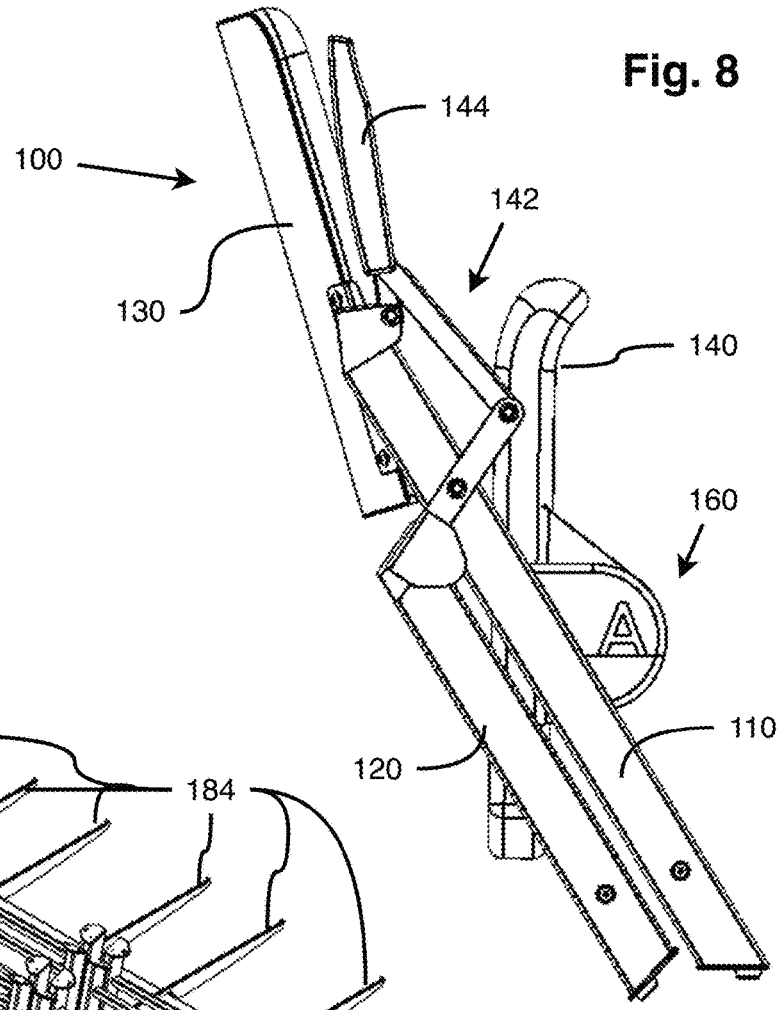
FIG. 8 is a side view of the folding chair of FIG. 7 with the seat in the upright position, the arms folded upright folded upright, and the legs folded in the collapsed position.
Figure 9:
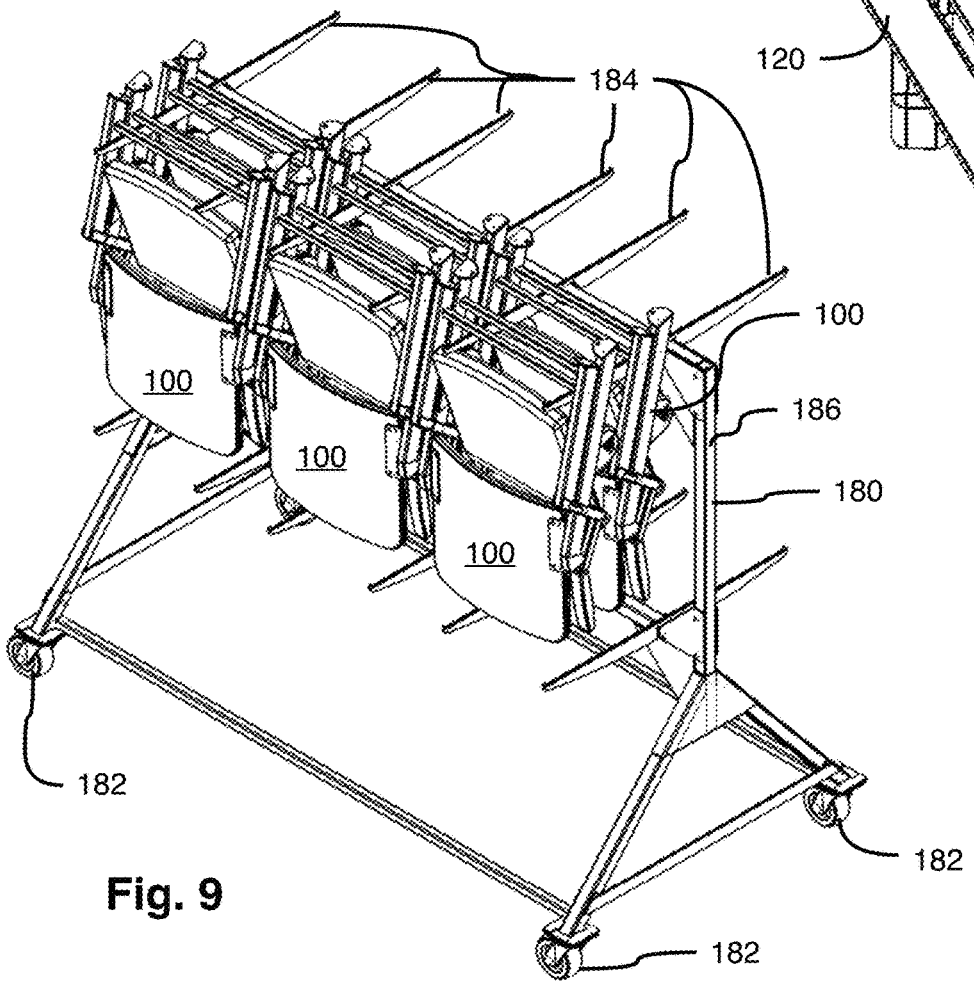
FIG. 9 is a perspective view of a rack with folding chairs of FIG. 1 in their most collapsed position hung thereon.

Referring to FIGS. 7 to 9, folding the rear leg assembly 120 along the front leg assembly 110 forces the front leg assembly 110 to adopt a collapsed configuration minimizing the thickness of the front leg assembly 110. Collapsing or expending the chair is synonymous of folding and unfolding the chair. When folding the rear leg assembly 120, the rear legs 122 butt up against the tabs 154, preventing the seat 140 to leave the upright position. Such forced configuration of the seat 140 in the upright position allows easy manipulation of the folding chair 100 with the free-rotating seat 140 remaining in the upright position regardless of the orientation of the folding chair 100, e.g., between bottom-down and bottom-up positions. If locking components such as the tab 154 were not present, changes in the orientation of the folding chair 100, e.g., for storage, would result in the seat moving, aka, flapping, as one person would turn the chair upside down, increasing thereby risks of injuries.

Figure 10:
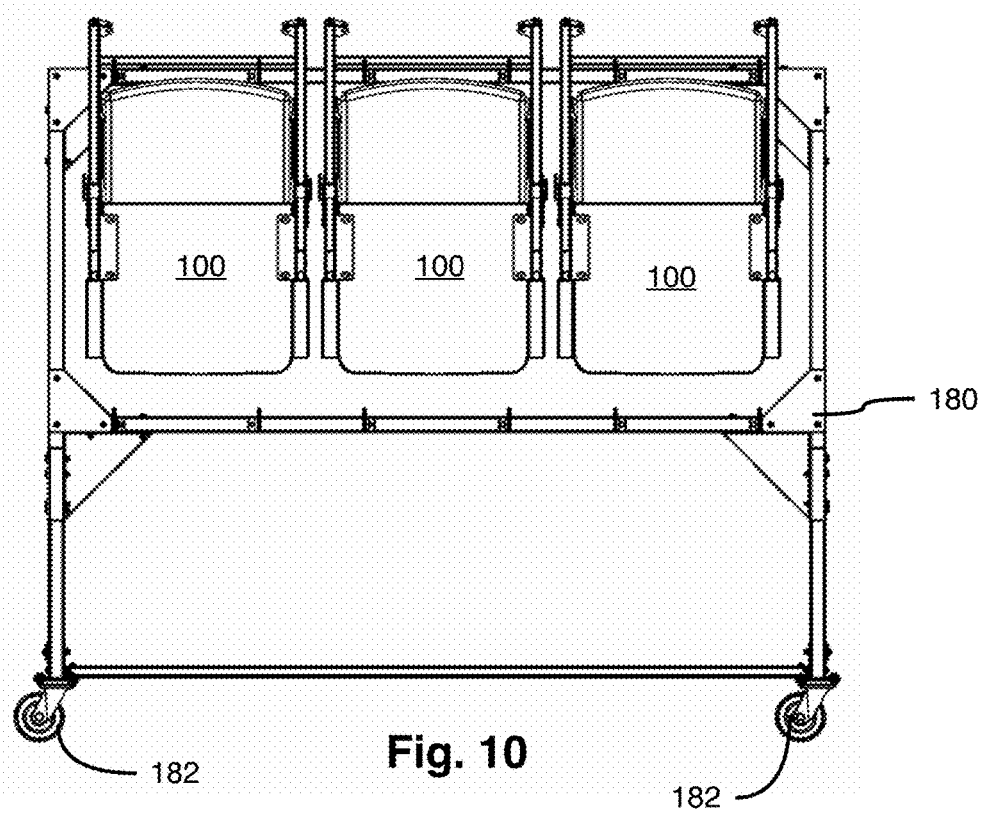
FIG. 10 is a front view of the rack and the folding chairs of FIG. 10.
Figure 11:
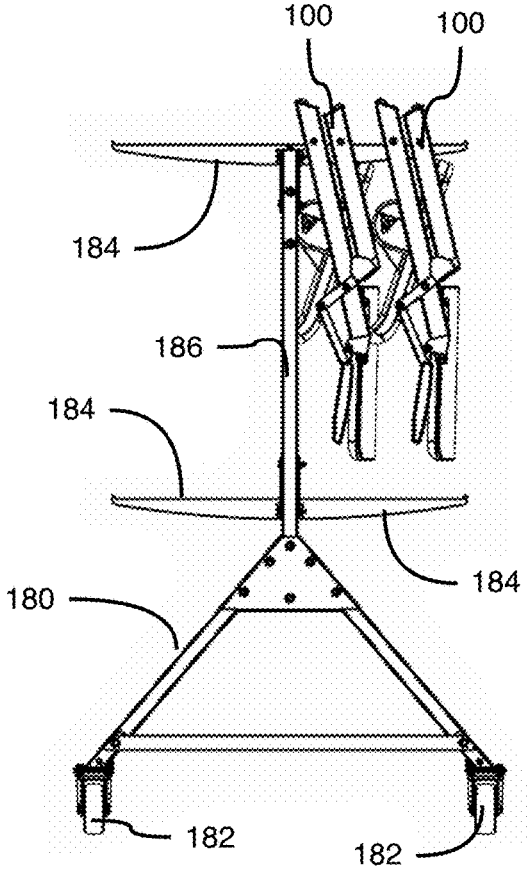
FIG. 11 is a side view of the rack and the folding chairs of FIG. 11.

Referring now to FIGS. 9 to 11, the folding chair 100 are adapted to be easily hangable on a rack 180 mounted on rollers 182 for easy storage. The rack 180 comprises a series of pairs of brackets 184 adapted for the transversal bars 116, 126 of the chair to be laid thereon.

According to an embodiment, the rack 180 comprises pairs of brackets 184 disposed in two levels on each side of a central structure 186 from which extend the brackets 184. On each side, each level features e.g., three (3) pairs of brackets 184. Each pair of brackets being able to receive about two (2) folding chair 100 in there collapsed configuration. Therefore, the exemplary rack 180 may be used to store up to twenty-four (24) chairs once hung thereon, to easily roll away the rack 180 to a storage area.

It is worth mentioning that the wedging of the tabs 154 allows to easily manipulate the folding chairs 100 with no portion of the folding chair 100 flapping. The folding chairs 100, in the depicted configuration, may be easily pulled from the brackets by pulling the backrest 130, the armrest 144, any of the front leg assembly 110 or the rear leg assembly 120, or even the seat 140 without any component flapping or the folding chair 100 tending to unfold.

It further allows the folding chair 100 to be hang on the opposite direction, aka with their seat 140 facing toward the central structure 186 of the rack 180, with the same advantages.

Referring to FIG. 1, FIG. 12 and FIG. 13, the seat mounting assembly 160 is mounted to the front legs 112 and provide a rotation axis 162 to the seat 140 front to the front legs 112. The seat mounting assembly 160 comprises a seat bracket 190 mounted to the seat 140, a rotatable component 192 adapted to rotatably mount the seat bracket 190 to a side plate 194 mounted to one of the front legs 112. The rotatable components 192 are designed to define together the rotation axis 162 extending in front of the front legs 112, and below the seat cushion 168. The seat mounting assembly 160 further comprises a pin 196 extending outwardly from the seat bracket 190 into an arched-shaped slot 198 having the rotation axis 162 as a center of curvature. The pin 196 is travelling in the slot 198 between a first extremity 201 potentially limiting the upright position of the seat 140, and a second extremity 202 limiting downward the seating position of the seat 140. A cap 204 is adapted to be mounted to the side plate 194, closing the mechanism and therefore preventing a person to pinch their fingers in the mechanism. An identification 206 may further be set on the cap 204 when, e.g., numerous folding chairs 100 are installed in rows and places are preset to people.

Figure 14:
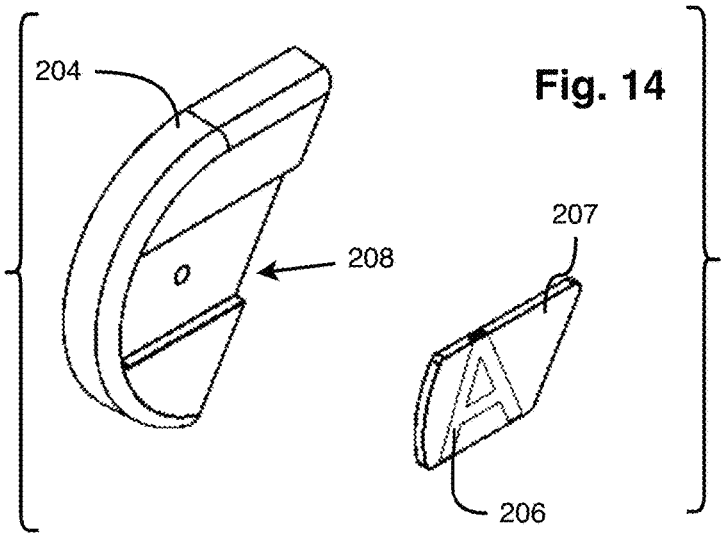
FIG. 14 is an exploded perspective view of a cap of a seat mounting assembly with a plate featuring an identification that can be snapped into the cap in accordance with an embodiment.

According to an embodiment, the identification 206 are removable. According to an embodiment, a magnet is stuck on the internal face of the cap 204, and the identifications 206 are made of e.g., ferrous material allowing to releasable attach the identification 206 to the chairs. According to another embodiment, magnetic releasable attachment of identification 206 relies on magnetic identifications 206 and e.g., ferrous cap 204 or cap shield (not show) mounted either to the internal face of the cap 204 or to the external face of the cap 204. According to another embodiment, identification 206 relies on a non-magnetic system to be temporarily mounted thereto. As depicted on FIG. 14, the cap 204 comprises a slot 208 wherein an identification plate 207 featuring the identification 206 may be snapped into the cap 204.

Figure 17A:
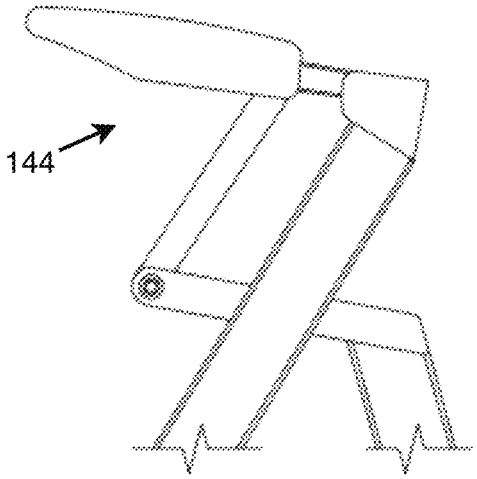
FIGS. 17A-17C partial side views of chairs with different designs and shapes of armrests.
Figure 17B:
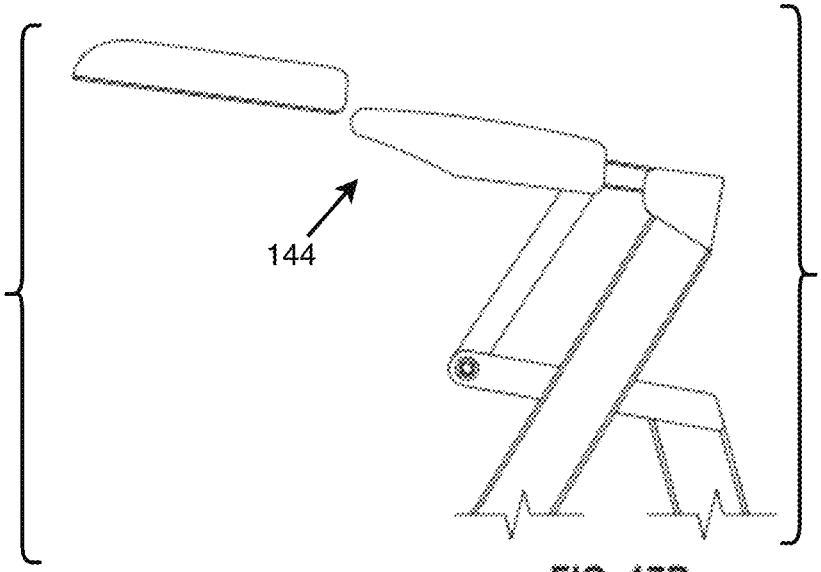
Figure 17C:
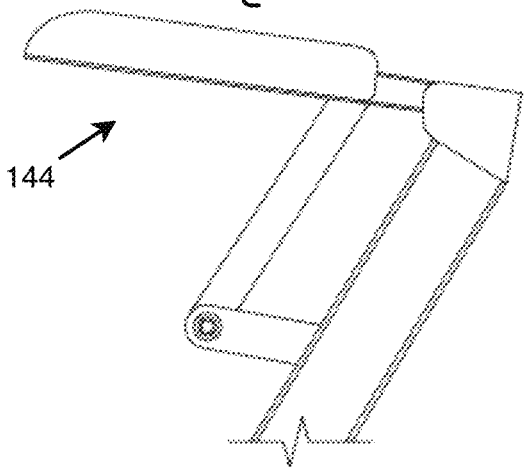

Referring now to FIGS. 17A to 17C, different embodiment of armrests 144 are provided, wherein the armrests 144 may be made of plastic, wood, rubber, or a combination thereof with or without integration of other material. Dimensions and shapes of the armrests 144 may vary between embodiments, wherein armrests may extend more forwards, may be wider, and may vary in the shape of their nose, in other words the foremost portion of the armrests 144, for instance. According to embodiments, the armrests 144 may consist in a single component, or a plurality of components statically mounted to each other and dismounted only when wear becomes a problem, or movable components wherein one consists in a base component and the other e.g., is telescopically movable relative to the base component, is rotatable relative to the base component, etc. Accordingly, regardless of composition, shape and features of the armrests, armrests may be configured to fold with the chair such the chair may adopt a compact configuration.

Figure 18:
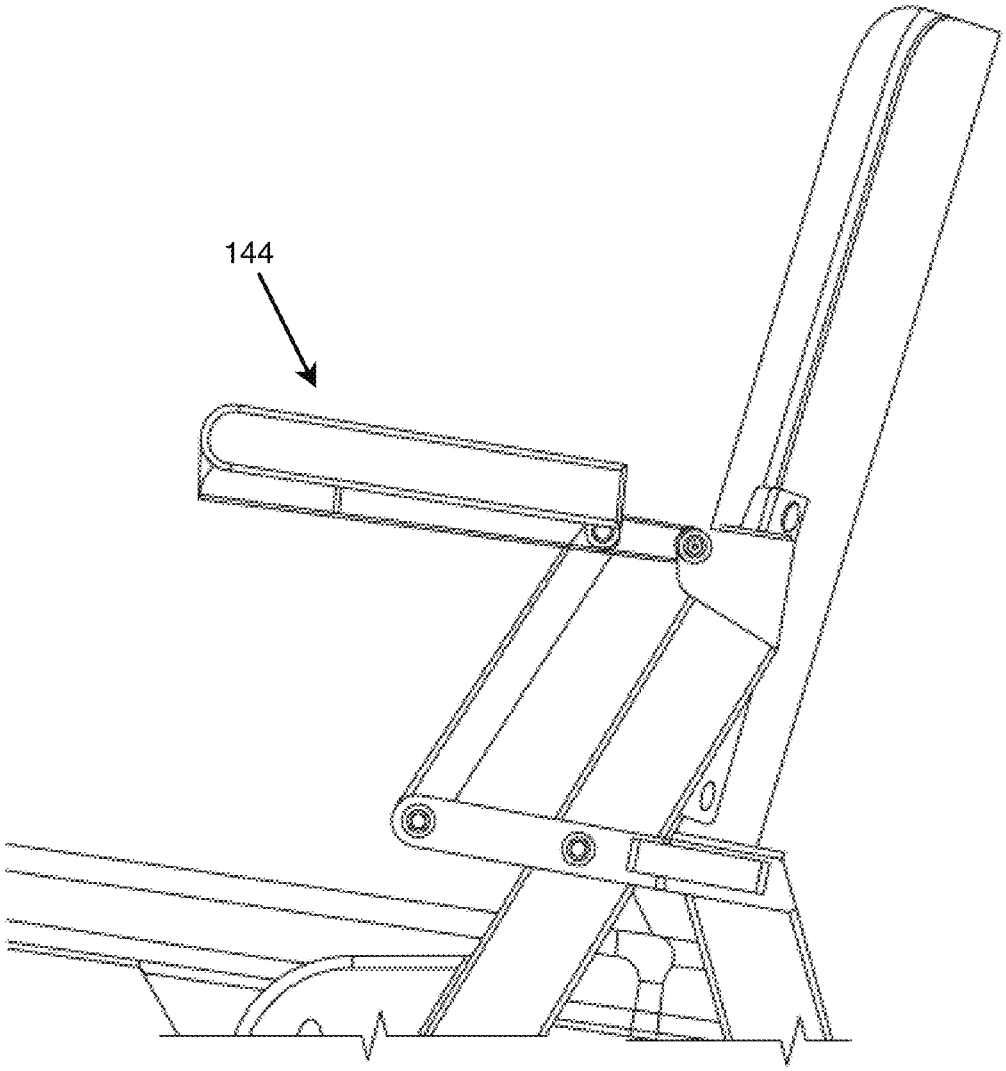
FIG. 18 is a partial side view of a chair with cover mounted to the armrest.

Referring to FIG. 18, in one embodiment, the armrest 144 comprises a cover 210 that may be mounted to the cushion of the armrest 144. Through FIGS. 17A-C and 18, it is herein contemplated that embodiments of armrests 144 may comprise one or may components, with components of different shapes, and with components assembled permanently while other removable from each other.

Figure 19A:
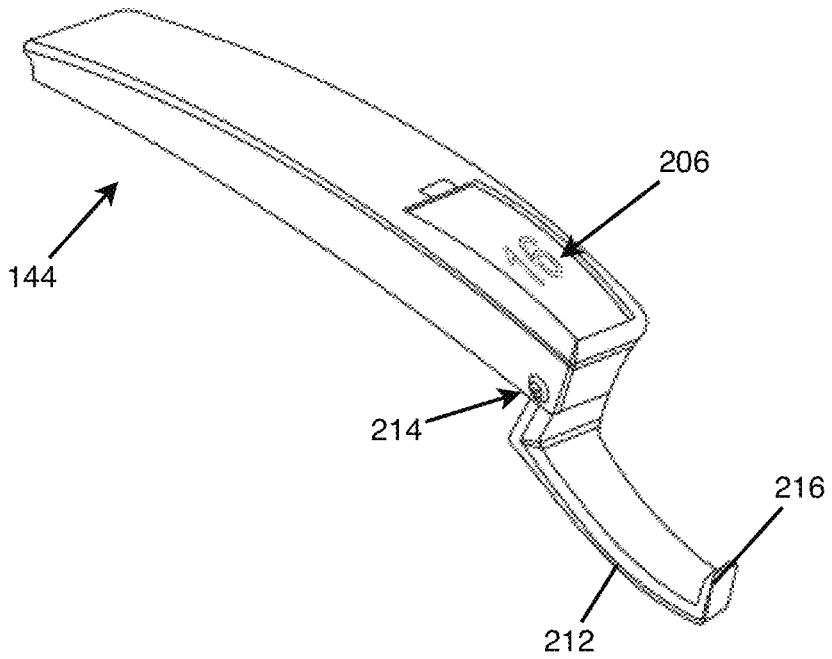
FIG. 19A is a perspective view of an armrest with an identification mounted thereto that is revealable though pivotal motion of a cover.
Figure 19B:
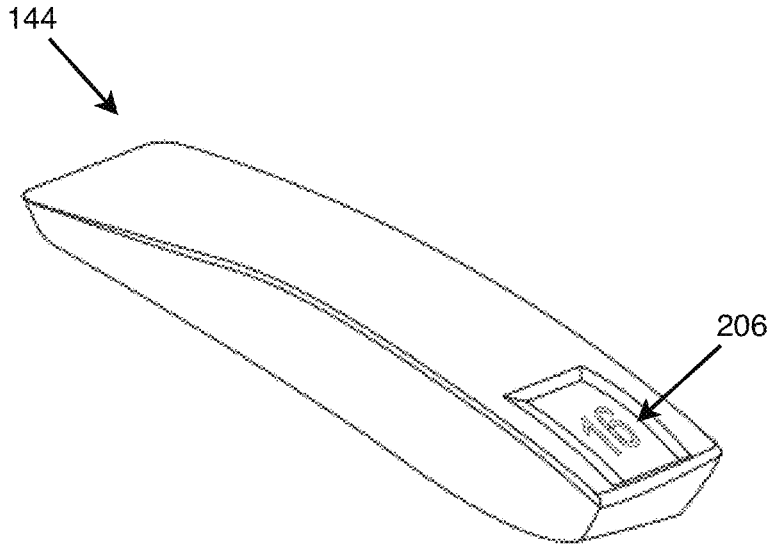
FIG. 19B is a perspective view of an armrest with a mountable identification mounted thereto.
Figure 19C:
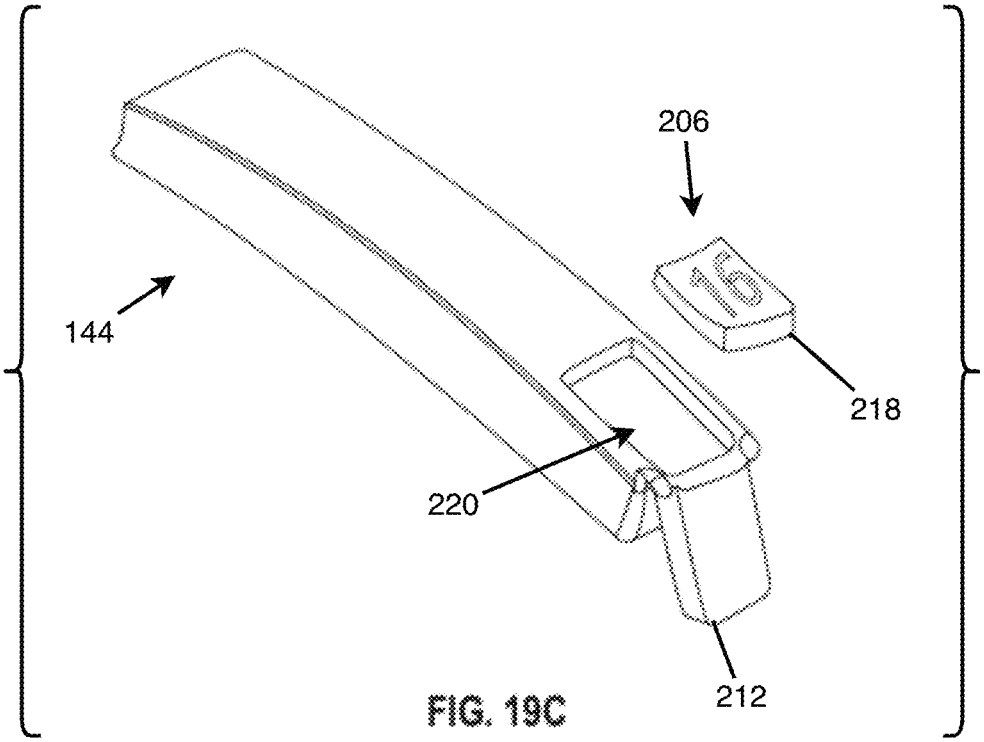
FIG. 19C is a perspective view of an armrest with an identification mounted thereto that is revealable though pivotal motion of a cover.
Figure 19D:
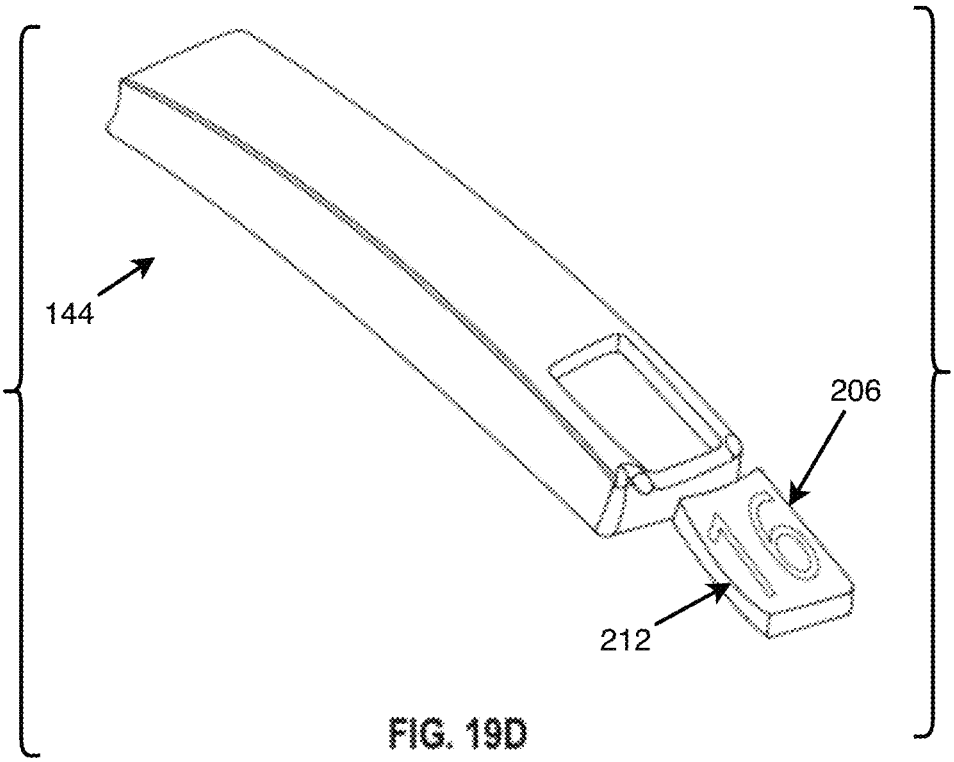
FIG. 19D is a perspective view of an armrest with an identification mounted to a rotatable component.

Referring to FIGS. 19A to 19D, embodiments of chair may involve an armrest 144 being designed to hold an identification 206. Referring to FIG. 19A, the armrest 144 may have an identification (e.g., an engraving, a label, a plaque, etc.) mounted thereto with a door 212 that one may open to look at the identification 206. According to an embodiment, the door 212 is mounted to a pivot 214 that allows the door 212 to hang under the armrest 144, and comprises a wedgeable component 216 that allows the door 212 once rotated to lay over the identification 206, to remain there until pulled. According to embodiments, alternative solutions to maintain the door 212 in place over the identification 206 may be used such as side wedging, magnetic hold, spring-mounted pins. FIG. 19B depicts an armrest 144 with an always visible identification 206, e.g., engraved, on a label, or magnetically clinging to the structure of the armrest 144. FIG. 19C depicts an armrest 144 with an identification 206 mounted to a plate 218 mountable, e.g., slidable or magnetically attachable, in a slot 220 in the armrest 144, with the identification 206 being hidable behind a rotatable door 212 of another embodiment. FIG. 19 D depicts an armrest 144 with a rotatable door 212 (depicted detached from the structure of the armrest 144) where the identification is mounted on the rear face (depicted facing up) of the door 212, the identification 206 becoming visible when the door 212 is rotated away from the armrest 144.

Figure 20:
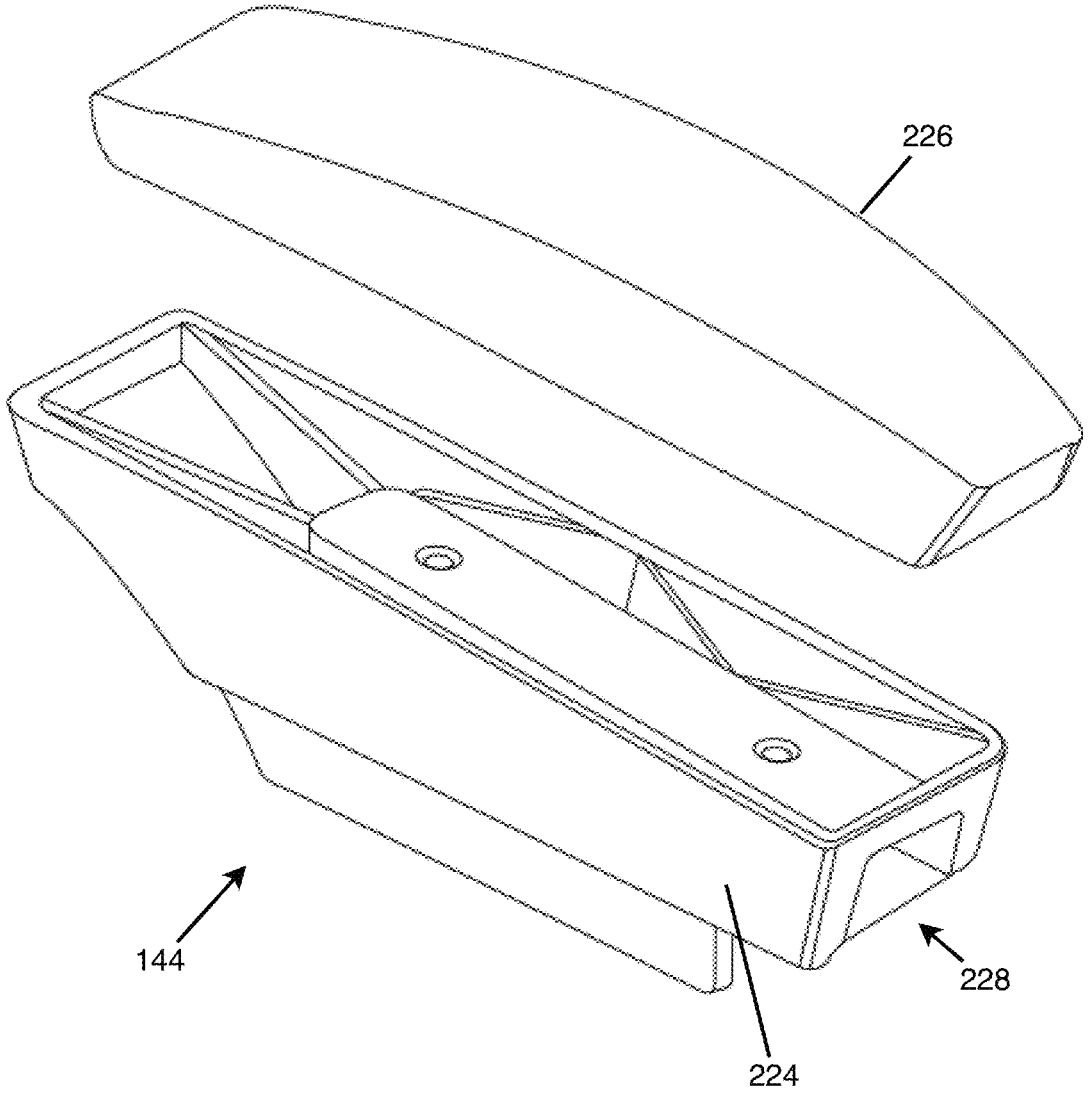
FIG. 20 is an exploded perspective view of an embodiment of an armrest.
Figure 21:
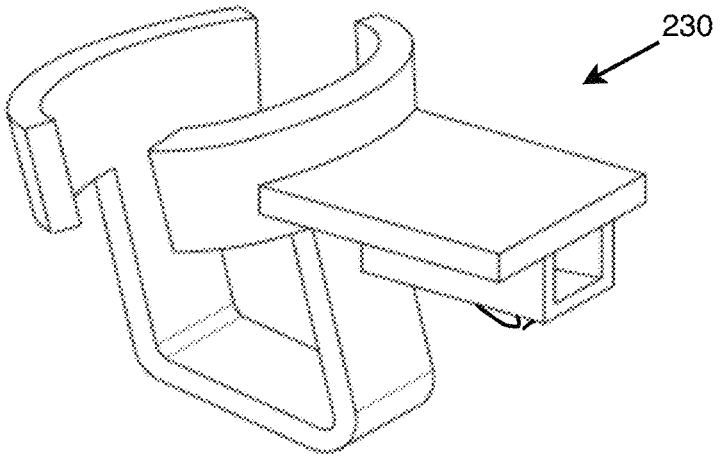
FIG. 21 is a perspective view of a cup holder mountable to an armrest in accordance with an embodiment.
Figure 22:
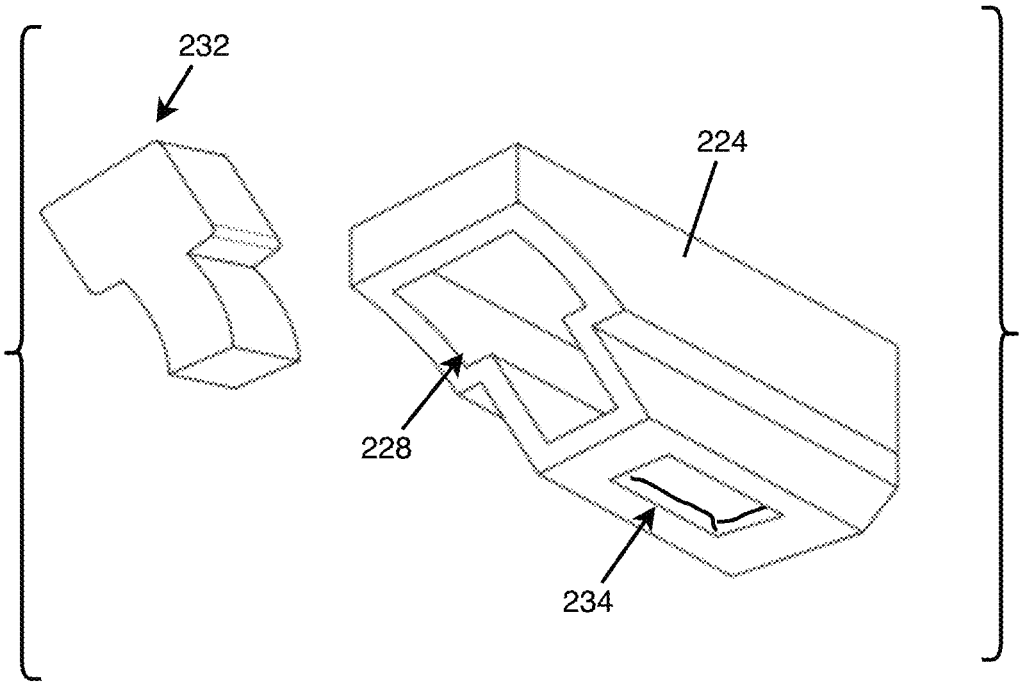
FIG. 22 is a perspective partial view of an armrest adapted to receive a cup holder with a removable cap.

Referring to FIG. 20, FIG. 21 and FIG. 22, an embodiment of an armrest 144 comprises a base component 224 to be mounted to the armrest assembly 142 (e.g., see FIG. 8) and a cover component 226 mountable to the base component 224. The base component 224 comprises a front opening 228 extending forwards in which the base 224 of an accessory, e.g., a cup holder 230 may be inserted to extend the use of the chair 100. A cap 232 may be mounted to close the front opening 228 when no accessories are to be mounted thereto.

According to an embodiment, the front opening 228 has a shape similar to a T. The base component 224 has additionally a bottom opening 234 adapted for a part of the accessory to enter the front opening 228 and to extend when inserted further in the front opening 228 to partially exit through the bottom opening 234, thereby wedging the accessory in place. To dismount the accessory from the armrest 144, one must therefore push upwards the wedging part of the accessory through the bottom opening 234 and pull the accessory forwards.

Figure 23:
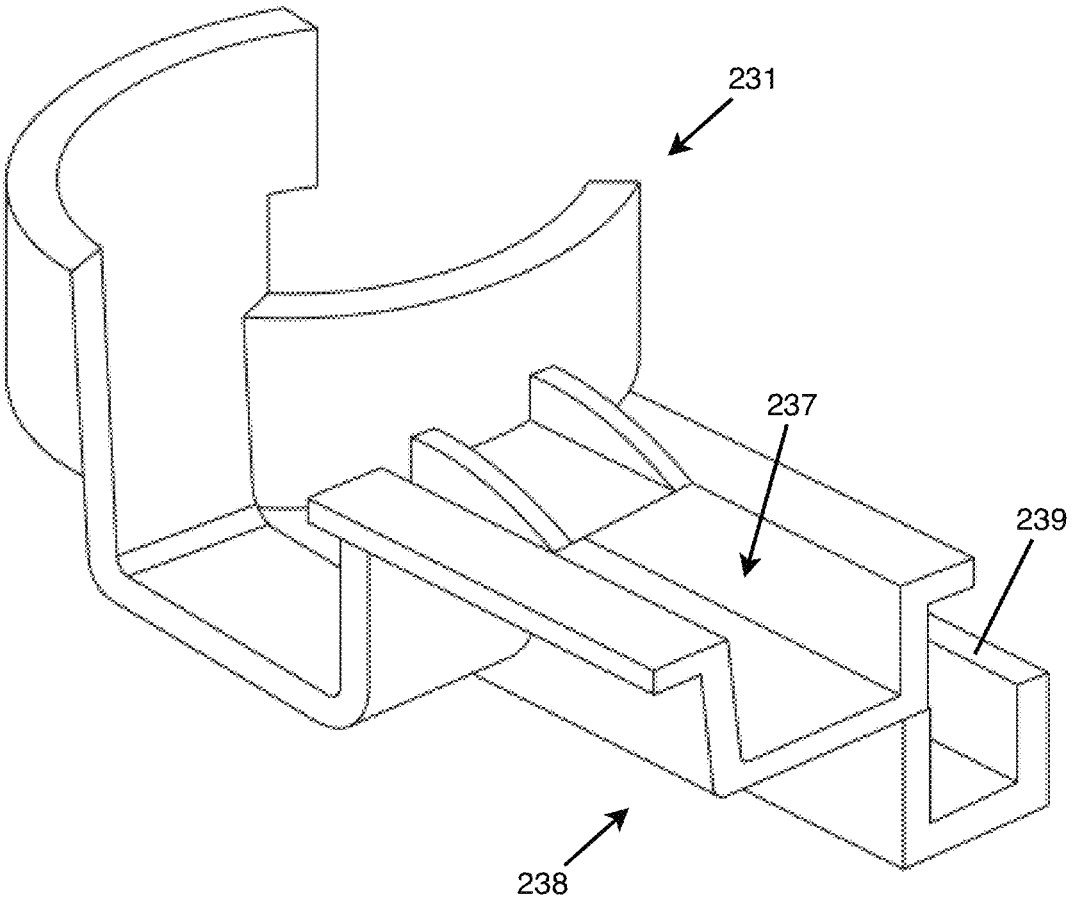
FIG. 23 is a perspective view of a telescopic cup holder mountable to an armrest in accordance with an embodiment.

It is worth mentioning that various accessories may be mounted thereto, with the dimension and adoptable position of the accessories determining if the accessories must be dismounted before folding the chairs or not. Such accessories may be static, e.g., depicted cup hold 230 of FIG. 21, or movable as the telescopic cupholder 231 of FIG. 23 that as a telescopic mounting structure 238 (with the part 239 shown rightmost being adapted to slide in the channel 237). Such telescopic structure allows to move the cup-holding portion away from the armrest 144.

Referring to FIGS. 24 to 29, identification holders 240 may be mounted to different parts of the chair 100 to hold visibly an identification 206 of the chair 100.

Figure 25:
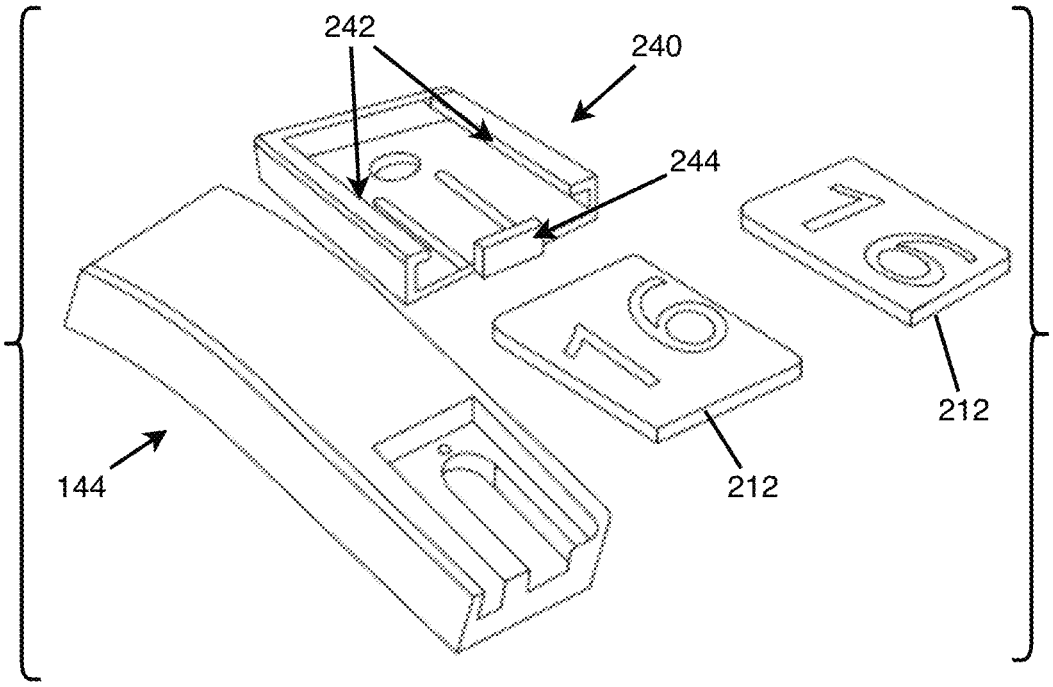
FIG. 25 is an exploded partial view of an armrest with an identification mounted thereto.

Depicted in FIG. 25, an identification holder 240 may be mounted to the armrest 144, with the identification holder 240 e.g., screwed to the armrest 144. Identification 206 may come as a plate 212 insertable in parallel grooves 242 with a movable tab 244 adapted to maintain the plate 212 in place once the plate 212 is fulling inserted in the identification holder 240. The plate 212 may be dismounted by pressing down the tab 244 and sliding the plate 212 out of the identification holder 240. According to embodiments, the identification 206 may be written transversal or longitudinal to the orientation of the armrest 144.

Figure 24:
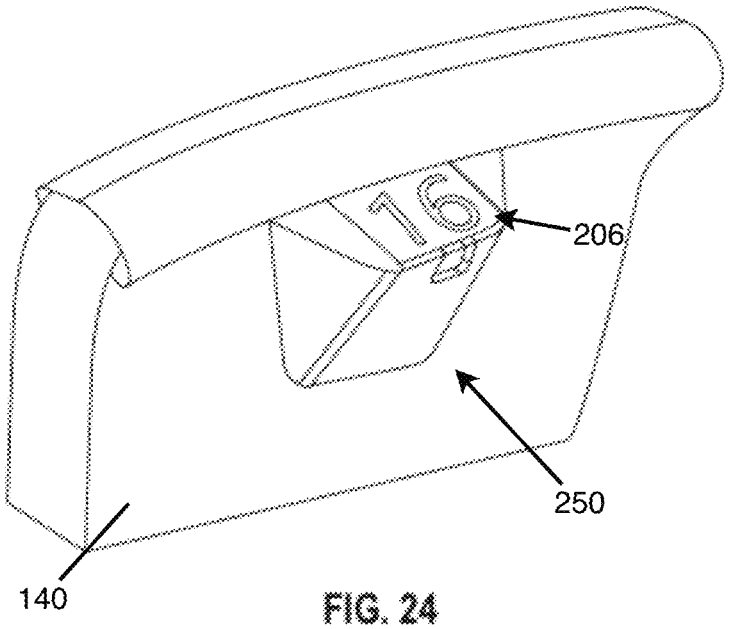
FIG. 24 is a partial perspective view of an upright seat with an identification mounted thereto.

Depicted on FIG. 24, an embodiment of an identification holder 250 may be mounted to the bottom face of the seat 140, e.g., centered widthwise to the seat 140, about the front edge of the seat 140. The identification holder 250 may be designed to have the identification 206 mounted thereto facing up when the seat 140 is upright. Therefore, the identification is visible when no one occupies the chair 100 but becomes visible as soon as one leaves the chair 100 since the seat 140 is biased to rotate upright.

Figure 26:
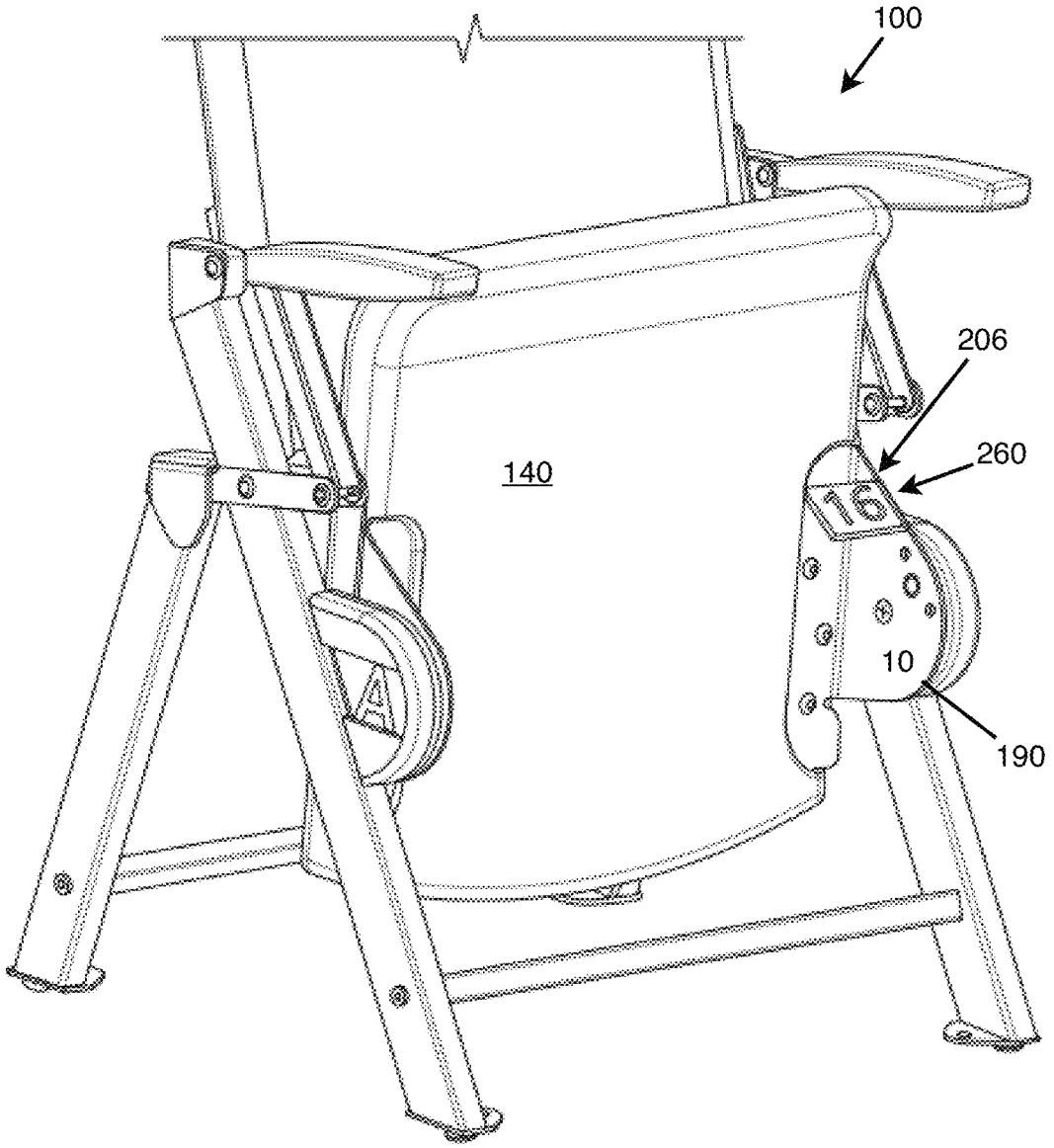
FIG. 26 is a partial perspective view of a chair with an identification mounted to the seat mounting assembly.

Depicted on FIG. 26, alternatively an identification holder 260 may be mounted to one or both (not depicted) of the seat brackets 190 with the identification 206 facing up/frontward when the seat 140 is upright. Similarly to the solution depicted on FIG. 24, the identification 206 is visible whenever no one occupied the chair 100.

Figure 27A:
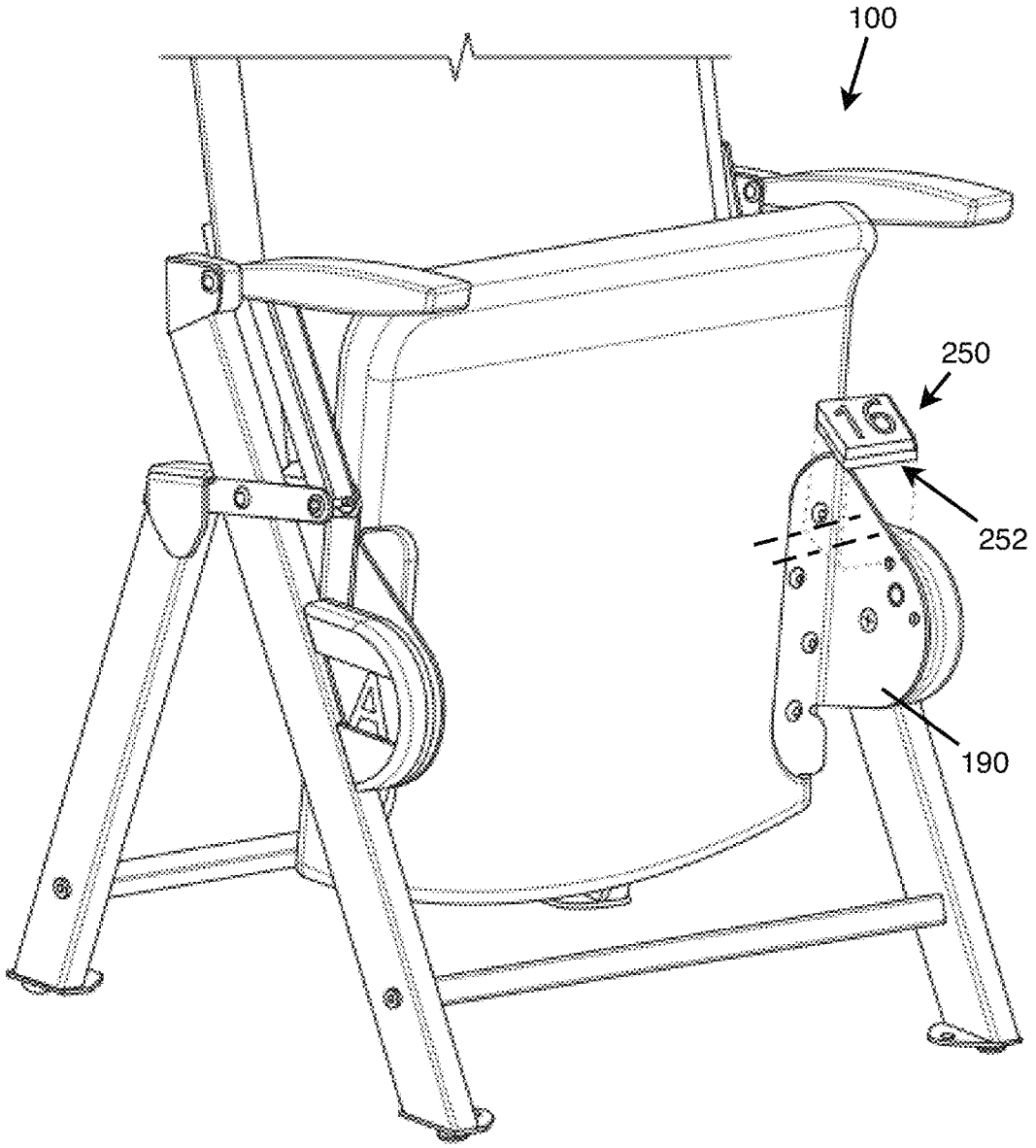
FIG. 27A is a partial perspective view of a chair with an identification assembly depicted distant from its mounting area.
Figure 27B:
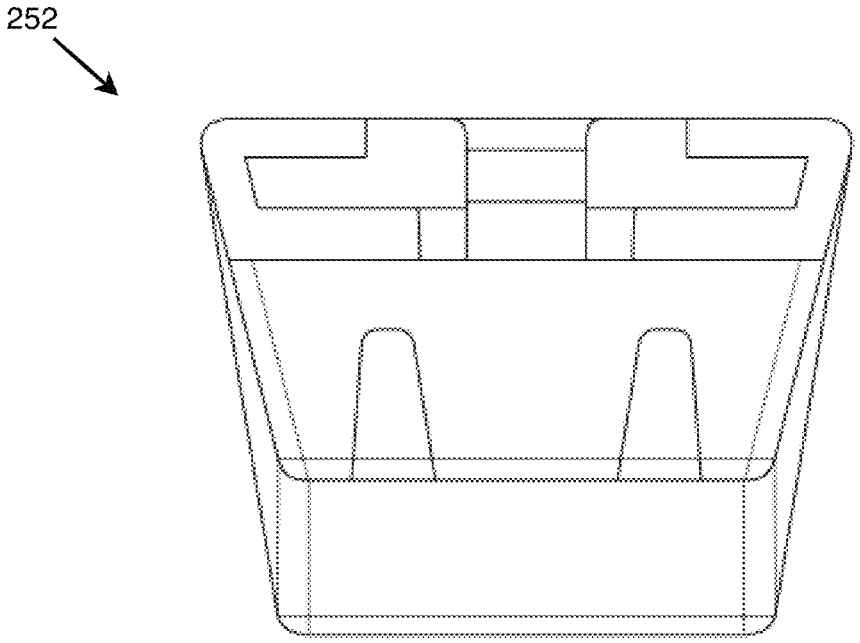
FIG. 27B is an elevation view of the identification assembly of FIG. 27A.
Figure 27C:
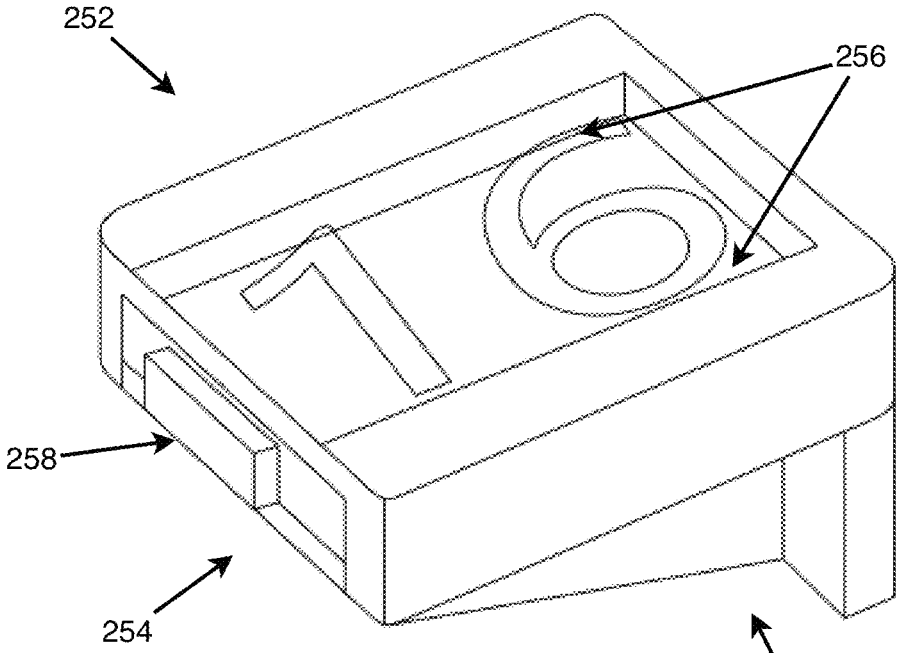
FIG. 27C is a perspective view of the identification assembly of FIG. 27A.
Figure 28A:
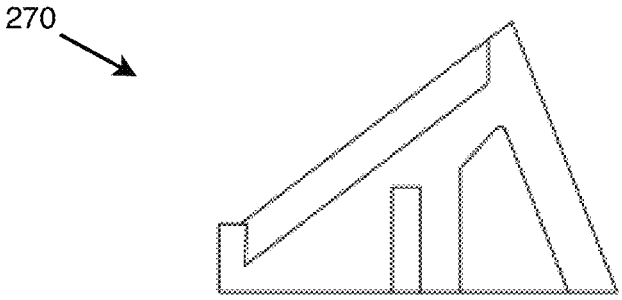
FIGS. 28A-28F are views of the base of an identification assembly in accordance with an embodiment.
Figure 28B:
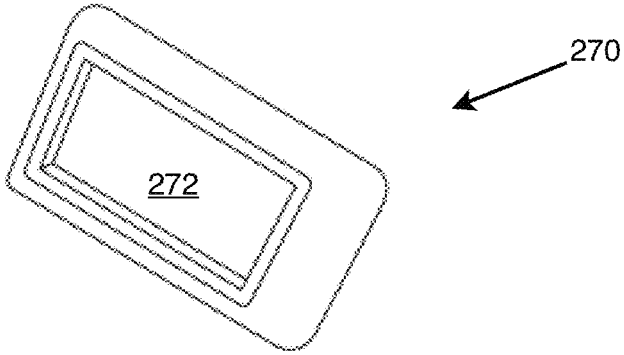
Figure 28C:
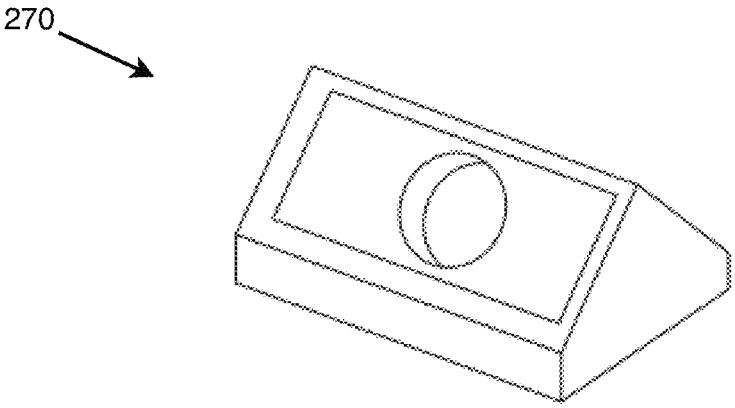
Figure 28D:
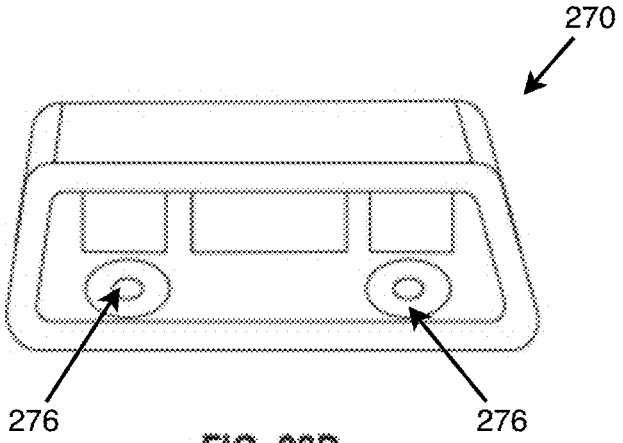
Figure 28E:
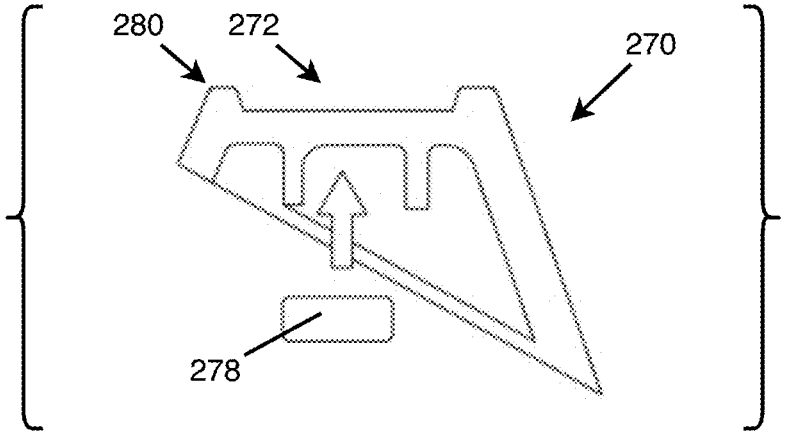
Figure 28F:
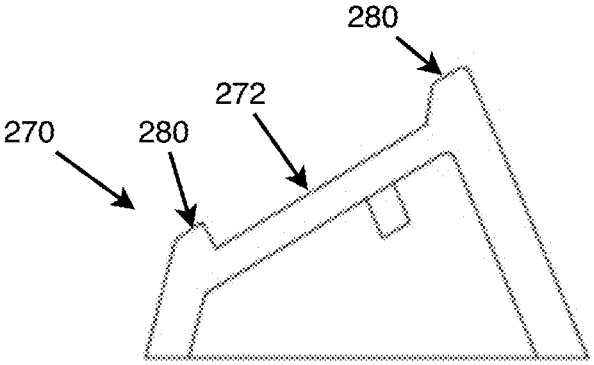

FIGS. 27A to 27C depict the mounting of the identification holder 250 to a seat bracket 190, and the generally structure of the identification holder 250 comprising a mounting part 252 designed to be mounted to the seat bracket 190. An identification holding part 254 comprising opposed grooves 256 and a plate retaining solution such a movable tab 258, and structural elements 259 designed to increase robustness of the identification holder.

FIGS. 28A to 28F depict an identification holder 270 designed to be mounted to the bottom face of a seat 140. The identification holder 270 is designed to be secured, e.g., screwed, to the bottom face of a seat 140. The identification holder 270 is designed to be mounted sloped relative to the surface it is mounted to. The identification holder 270 comprises a holding face 272 sloped relative to the mounting surface. Screws for mounting the identification holder 270 to the seat 140 are insertable by the holding face 272 (through holes 276). According to an embodiment, a magnet 278 is wedged to body about the holding face 272. A lip 280 surrounds the holding face 272. An e.g., metallic plate 212 on which the identification 206 is laid on the holding face 272. The plate hides the screws. The magnet 278 holds the plate 212 in place. And the surrounding lip 280 prevents someone to cut themselves on the plate 212.

Figure 29:
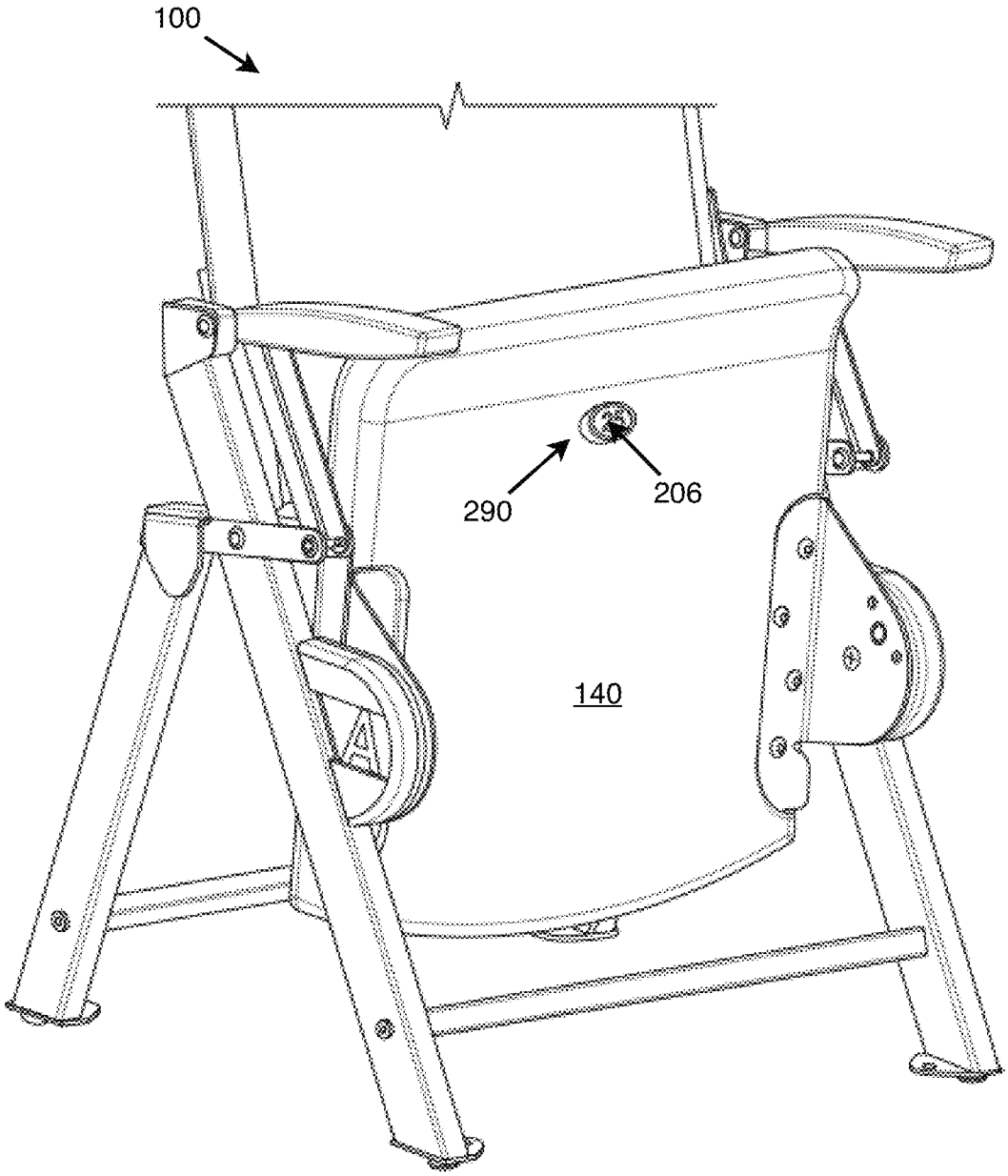
FIG. 29 is a partial perspective view of a chair with an identification mounted to the seat.

FIG. 29 depicts another embodiment of an identification 206 mounted to an identification holder 290 itself mounted to the bottom face of the seat 140.

Accordingly, the present document contemplates different solution to mount identifications 206 to chairs, with the identifications being either permanent or removable, always visible, or revealable, and being potentially mounted to the chair must be visible only when the seat is unoccupied.

Figure 30A:
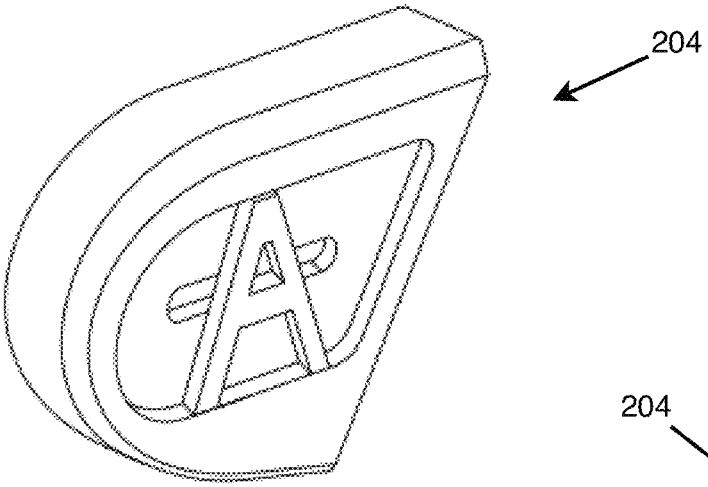
FIGS. 30A-30C are view of an identification mounted to a cap, either as a letter or a plate with the letter engraved or being raised relative to the plate, either inserted and wedged therein or permanently mounted thereto.
Figure 30B:
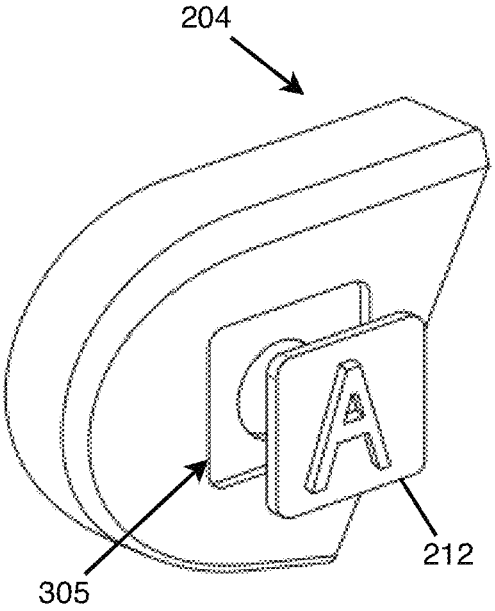
Figure 30C:
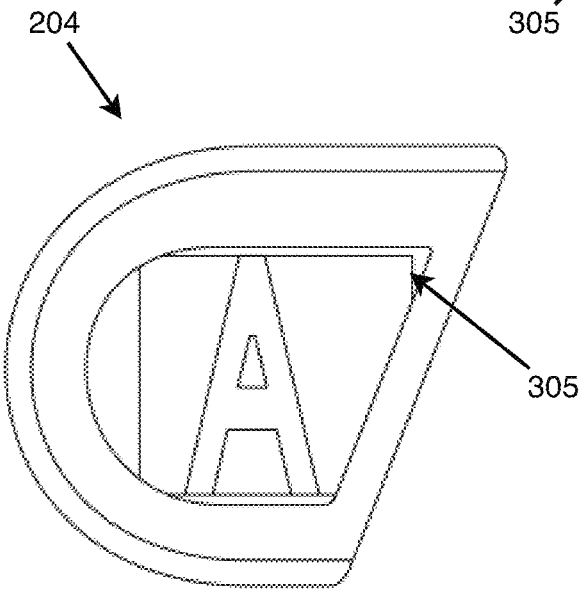

Depicted in FIGS. 30A to 30C, the cap 204 (e.g., see FIG. 3) may feature embodiments for an identification 206 to be mounted thereto. According to embodiments, only e.g., a letter may be mounted to the cap 204, a plate 212 featuring the letter wedged in an at least partial enclosure 305 and filling substantially the whole enclosure 305, with the wedging of the plate 212 in the enclosure 305 retaining the plate 212 in place. Another embodiment depicts a plate 212 filling only a portion of the enclosure 305. According to embodiments, the enclosure 305 and the plate 212 may feature complementary shapes designed to ensure that the plate 212 remains wedged in the enclosure 305. Securing means such as glue, screws, magnet, etc. may also be used alone or in combination to correctly secure the identification in place.

Figure 31A:
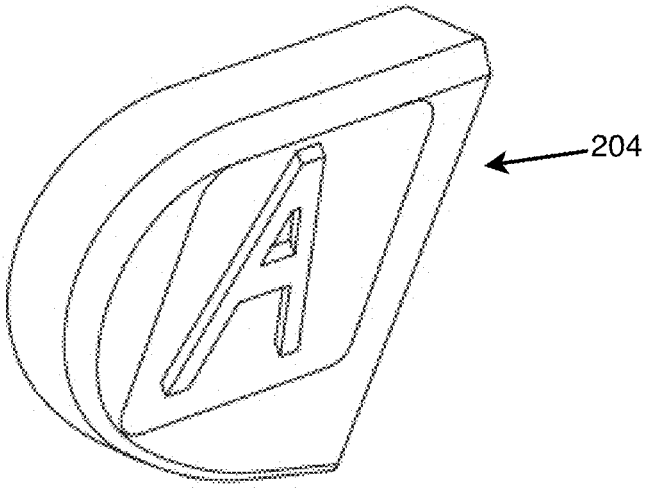
FIGS. 31A-31B are view of an identification mounted to a cap, sled in place, and/or wedged in place using.
Figure 31B:
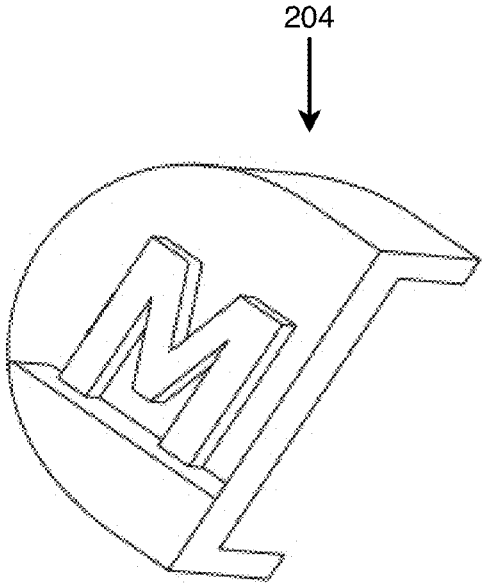
Figure 31C:
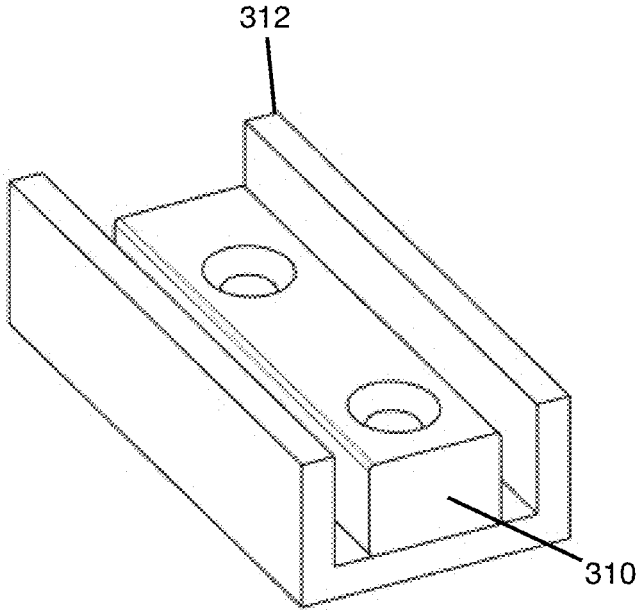
FIG. 31C is a perspective view of a magnetic holder enclosed in the cap of the seat mounting assembly.

FIGS. 31A to 31C depicts an embodiment wherein a magnet 310 is used, with the magnet 310 being mounted on the interior side of the cap 204 on a holder 312.

Figure 32:
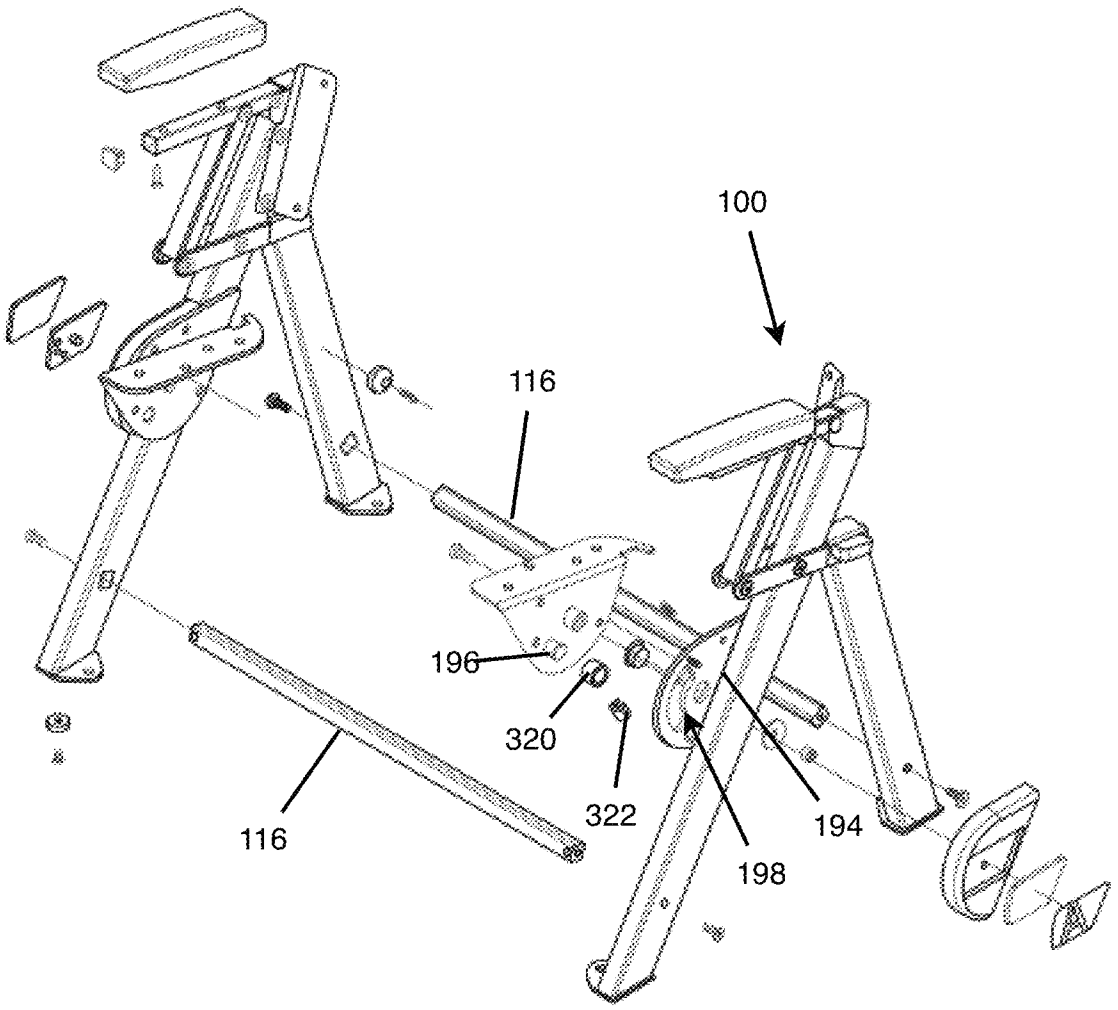
FIG. 32 is an exploded partial view of a chair depicting that length of bars may be customized to adapt to different width of seats and backrests, and identifications mounted to the outer face of the seat mounting assembly.

FIG. 32 depicts an exploded view of an embodiment of a chair 100, showing that customization of the chair 100 are available during the manufacture, including widening the chair 100 with longer transversal bars 116, and use of rings or other sliding elements wherein rotating components are assembled to ease relative rotation. For instance, FIG. 34 depicts a compressible sleeve 320 mounted to the pin 196 and a damping cushion 322 mounted to the side plate 194, wherein the sleeves 320 are offering a first level of damping at one end-of-course of the pin 196 in the slot 198, and wherein a combination of the sleeve 320 and the damping cushion 322 on each side offers an improved damping at the other end-of-course of the pin 196.

Figure 33:
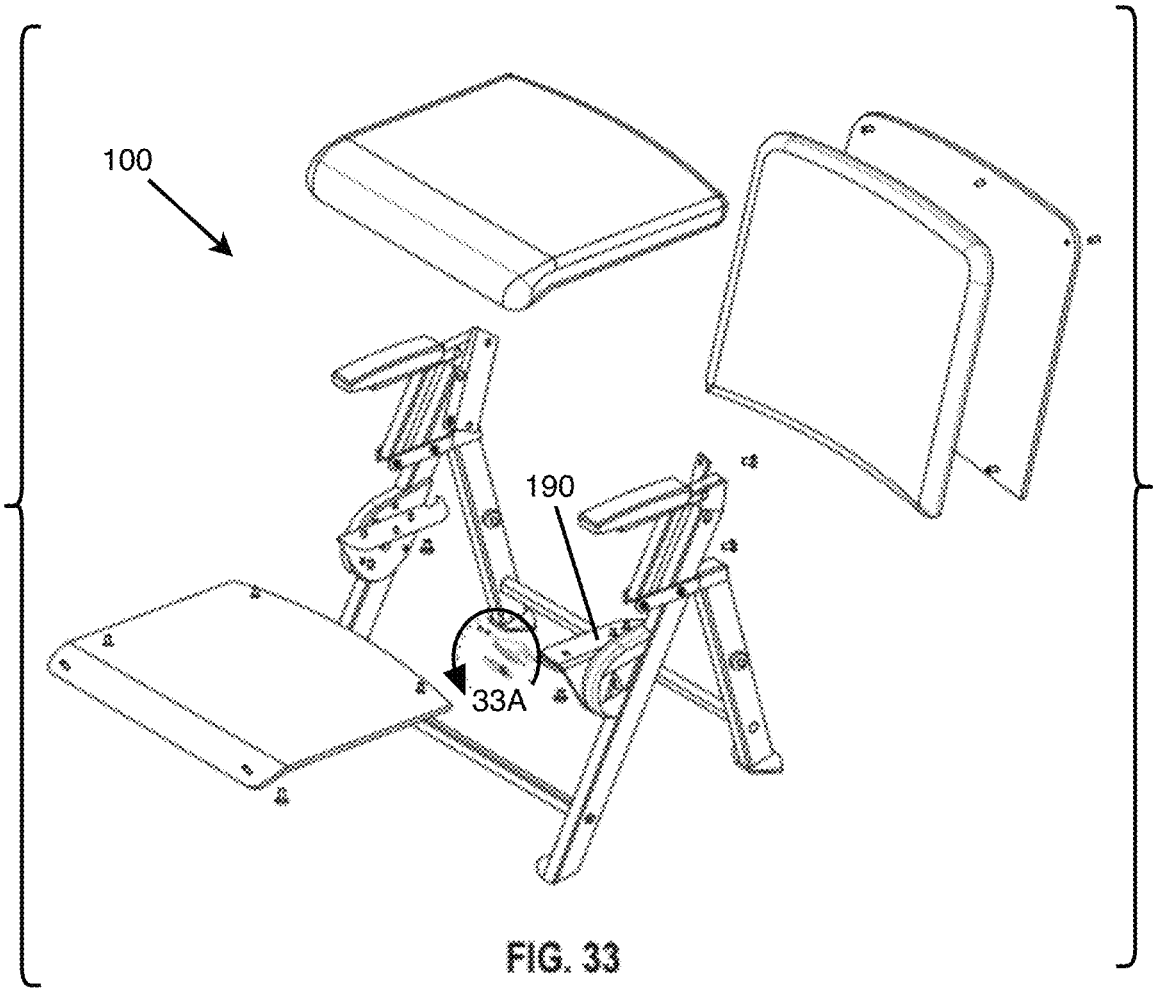
FIG. 33 is an exploded view of a chair with an identification mounted to the inner face of the seat mounting assembly.
Figure 33A:
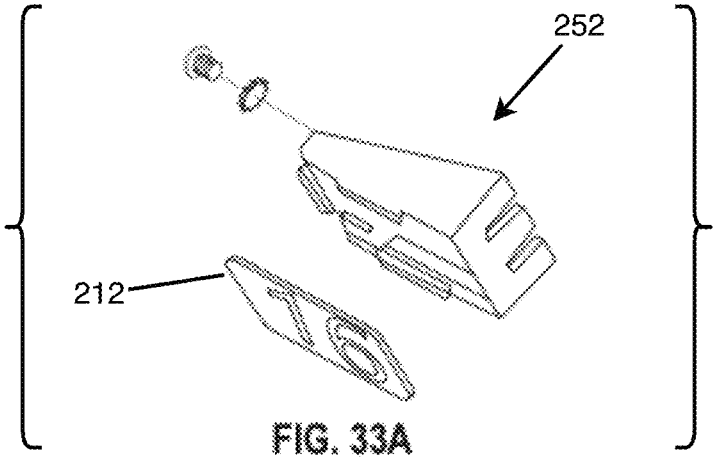
FIG. 33A is a closeup perspective view of the mounting part and the identification plate of the embodiment depicted in FIG. 33 in accordance with closeup arrow 33A identified on FIG. 33.

FIG. 33 and FIG. 33A depict via a partially exploded view and a closeup view another embodiment of a chair 100 with an identification holder 252 mounted to a seat bracket 190.

Figure 34A:
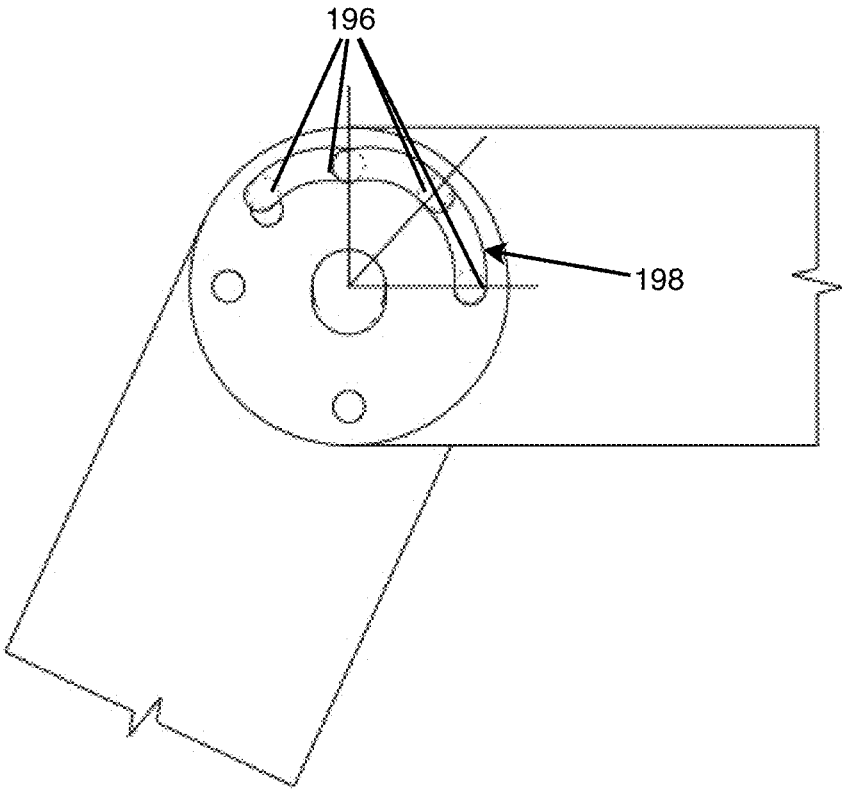
FIGS. 34A-34C are side views of an alternative seat mounting assembly featuring a stable intermediary position wherein the seat must be forced out of the intermediary position to get into the seating position or the upright position.
Figure 34B:
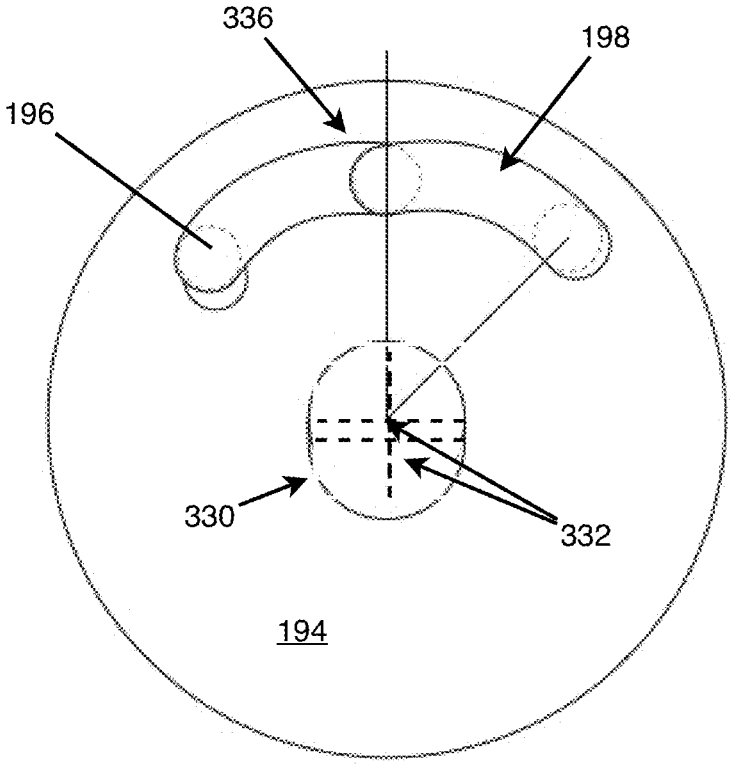
Figure 34C:
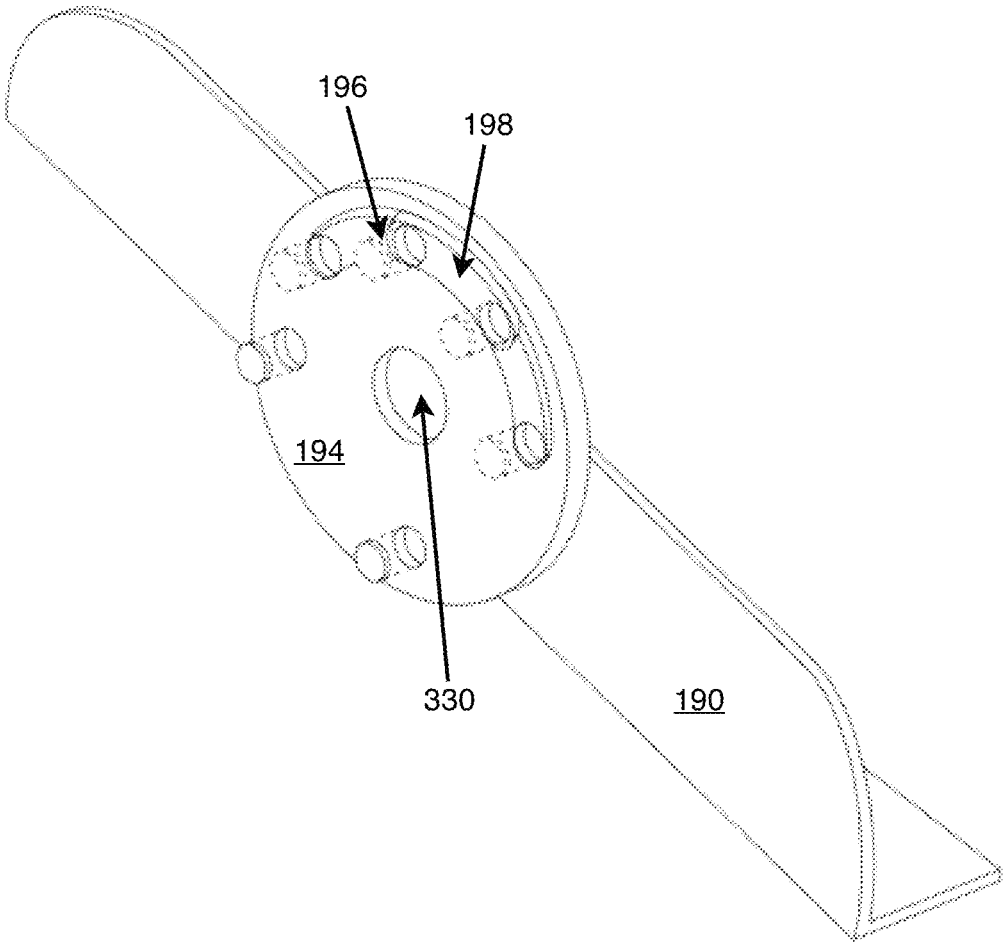
Figure 35C:
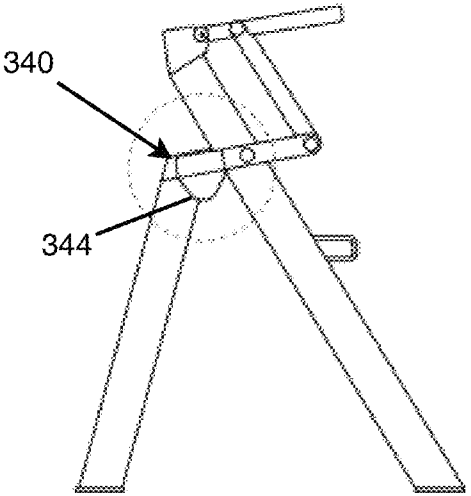
FIGS. 35C-35D are respectively a left side partial view of a partial chair adapted for ganging and associated detailed view identified therein.
Figure 35B:
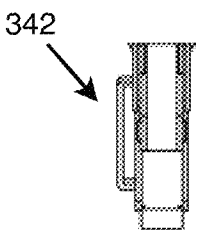
FIGS. 35A-35B are respectively a front partial view of a partial chair adapted for ganging and associated detailed view identified therein.
Figure 35A:
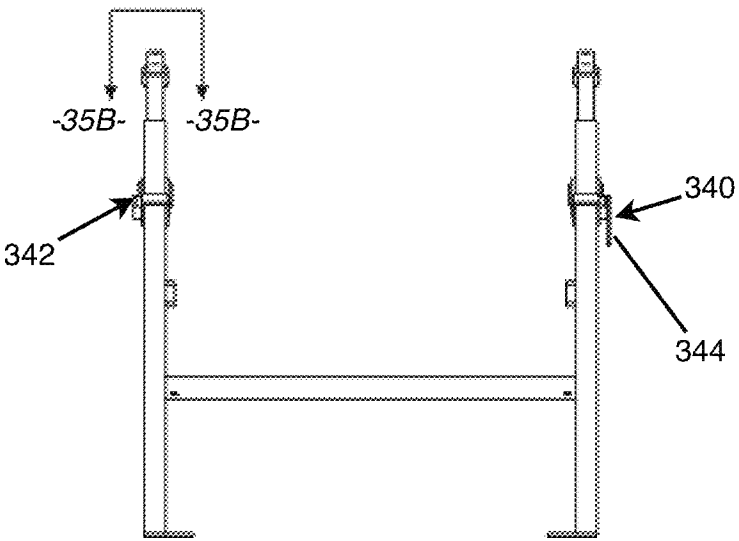
Figure 35F:
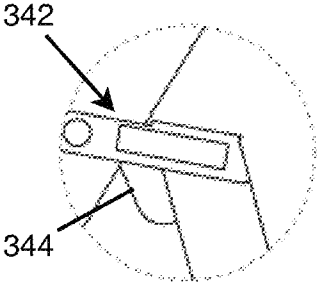
FIGS. 35E-35F are respectively a left side partial view of a partial chair adapted for ganging and associated detailed view identified therein.
Figure 35E:
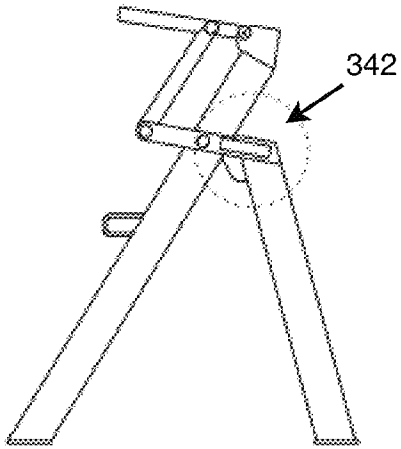
Figure 35D:
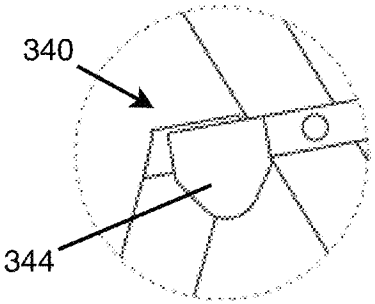
Figure 35G:
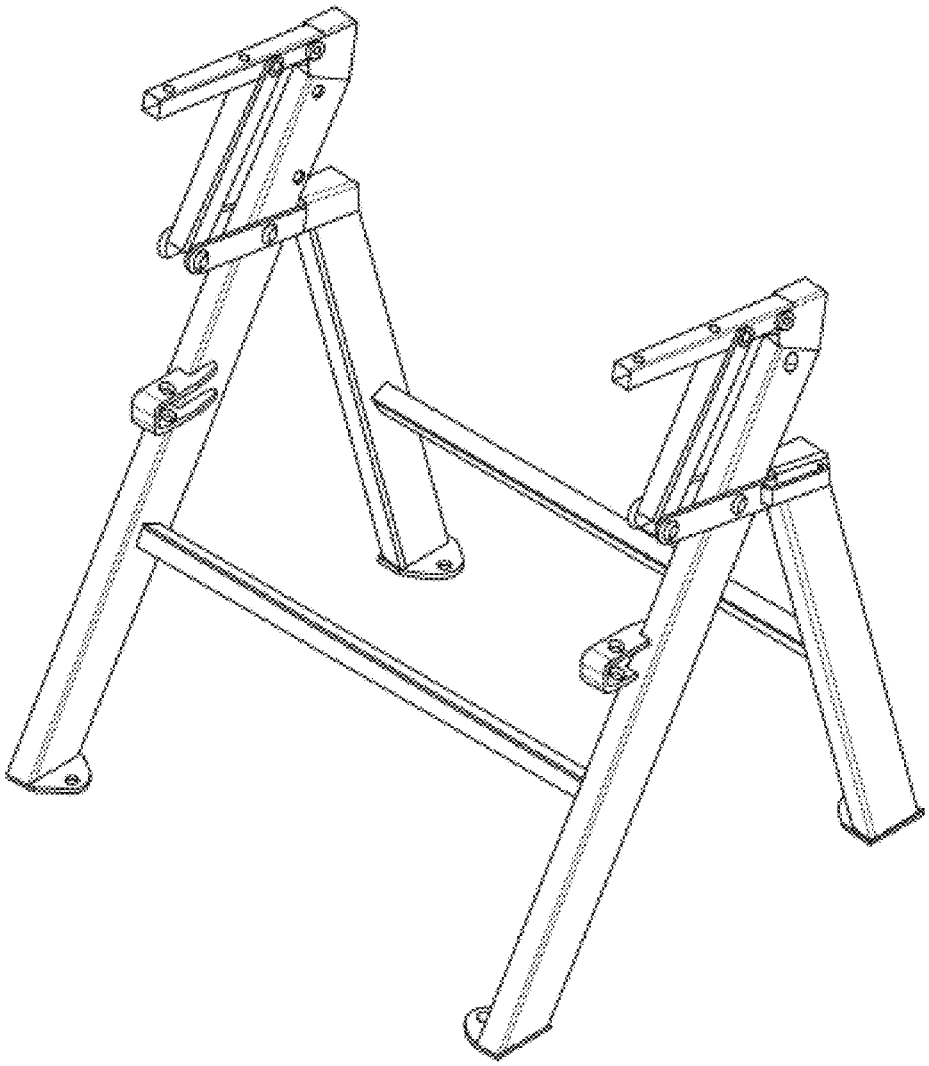
FIG. 35G is a perspective partial view of a partial chair adapted for ganging.

Referring now to FIGS. 34A to 34C, an embodiment of a chair may be adapted to hold the seat in three default positions: a seating position, an upright position, and an intermediary position. Accordingly, the course of the pin 196 (depicted in FIG. 34A from left to right in a first end-of-course position, in the intermediary position, in another non-stable position, and in the second end-of-course position) may presents a hindrance between the end-of-course positions, preventing the counterweight to get the seat 140 upright by itself if not helped to rotate beyond the intermediary position.

Practically, such an embodiment of a chair 100 is particularly well adapted for people having physical limitations. Such chair provides by default a good clearance upfront. However, it does not require that the person desiring to sit on the seat to do it rapidly after having rotated the seat in the seating position. If not maintained in the seating position, the seat will rotate up to its intermediate position at a height that is easy for a person to sit on while providing clearance up front. Therefore, the chair offers all the time the person requires to turn around and sit while remaining having an upright default seat position. Furthermore, simple folding motions of the legs are enough to overcome the force keeping the seat in the intermediary position and thereby having the seat moving to its upright position.

According to an embodiment, the slot 198 features an irregularity at the intermediary position slowing down the movement of the pin 196 requiring a slight compression of the sleeve mounted to the pin to pass over.

According to an embodiment depicted through FIGS. 34A to 34C, the slot 198 features an irregularity between the end-of-course positions. According to the exemplary depicted embodiment, the slot 198 takes the shape of an arch shape with a downward wave 336 at the intermediary position. The shaft hole 330 of the side plate 194 is oblong, allowing to have a fix distance between the slot 198 and a pivot axis 332 in all positions of the pin 196. Practically, the course of the pin 196 between a first end-of-course position keeps the seat rotating around the upmost pivot axis. When reaching the downward wave 336 position, the pivot axis 332 drops to the downmost position keeping a fix distance to the pin forced to move slightly downwards by the wave 336. To continue its course towards an upright position with the pin 196 reaching the second end-of-course position, or to rotate back to the first end-of-course position, the seat 140 needs to receive a small external force necessary for the shaft of the seat bracket, thus the pivot axis 332, to raise to the upmost position for the pin 196 to continue its course. Thereby, a stable intermediary position is provided.

Figure 37:
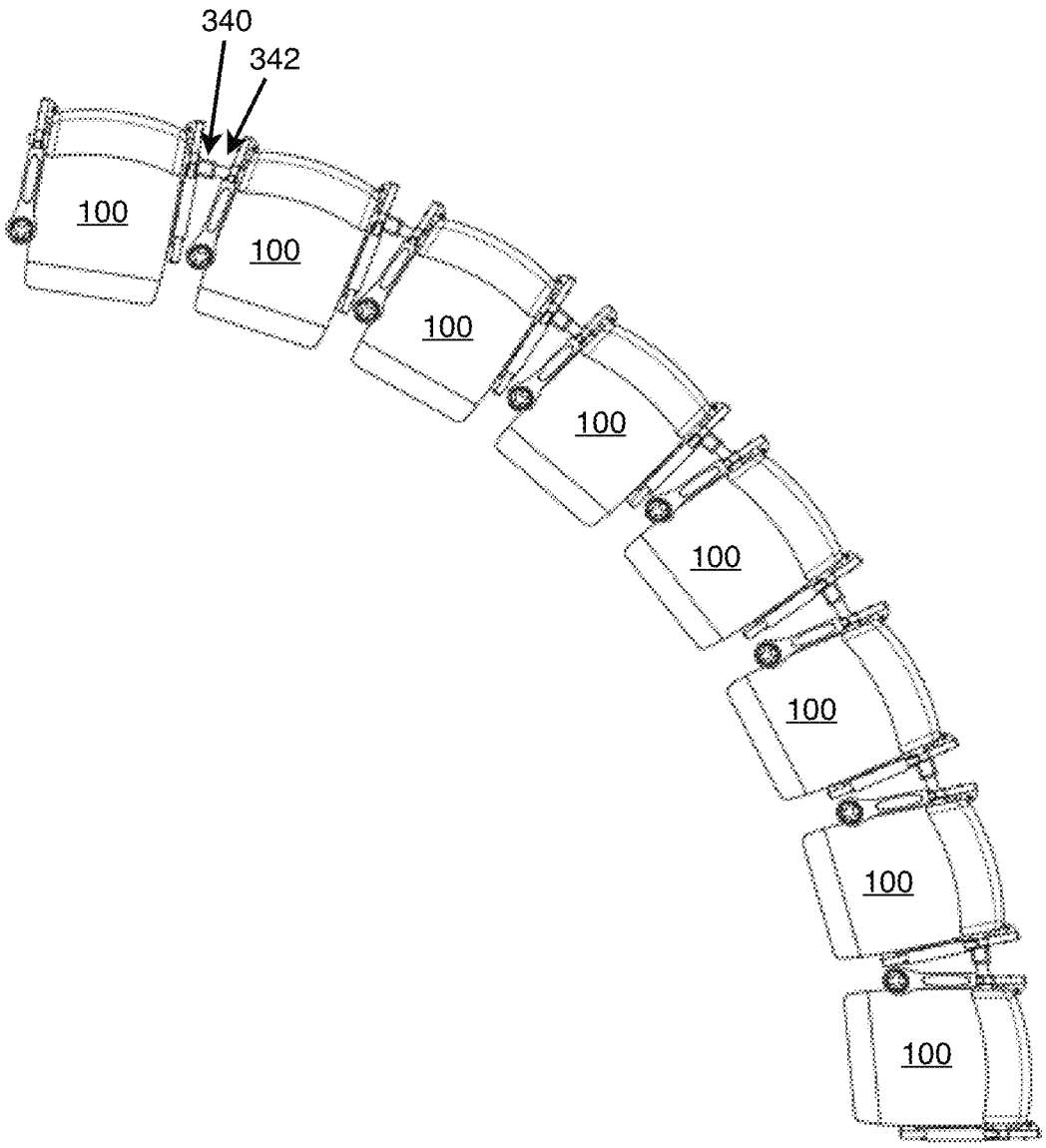
FIG. 37 is a plan view of a row of ganged chairs in an arched configuration.

Referring now particularly to FIGS. 35A to 35G, an embodiment of the chair 100 features a hook component 340 mounted to one leg on one side and a loop component 342 mounted to the leg on the other side. The hook component 340 features a prong part 344 extending distant from the leg downwards. The prong part 344 is designed to be inserted in the hook component 342 taking place between the leg and the distal part of the hook component 342 to link the chair 100 to a neighbor chair. Similar mechanic applied to the hook component 342 where the prong part 344 of a neighbor chair may be inserted to link them. Accordingly, a chain of chairs 140 having substantially constant distance therebetween may be formed from these link chairs 140. Space between the leg and the distal part of and loop component 340 compared to the thickness of the prong part 344 provides some possibility to place the chairs 140 parallel or at a non-zero angle therebetween. With a non-zero angle therebetween, the chain of chairs may form an arc while maintaining the linking therebetween. FIG. 37 depicts an example of such arc-shaped chain of chairs 140.

Referring to FIGS. 36A to 36D, depictions of embodiments of components for linking chairs are depicted.

Figure 36A:
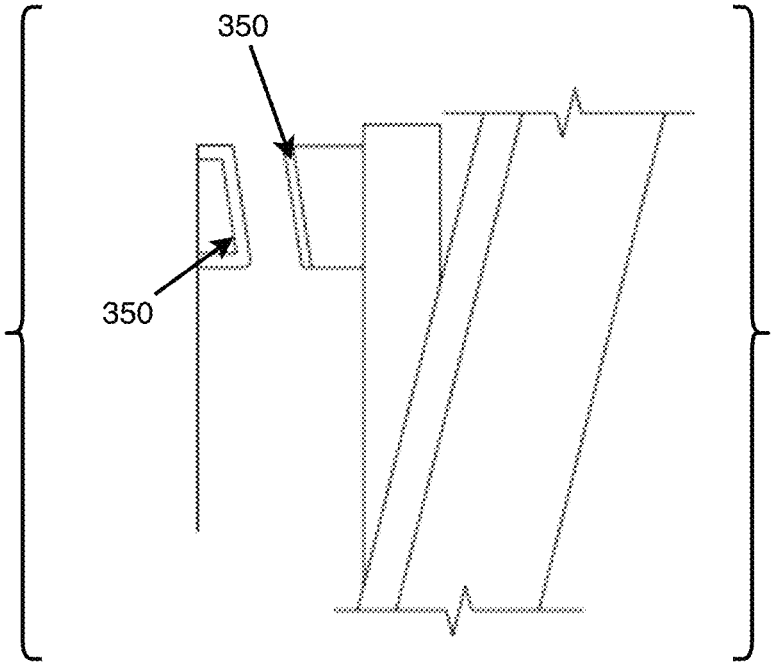
FIGS. 36A-36D are partial views and components of chairs involved in ganging chairs into row of chairs in accordance with embodiment.

In FIG. 36A, an exemplary embodiment involves magnets to cling chairs together. According to embodiments, clinging surfaces 350 may be plane surfaces, hemispherical surfaces, or a combination thereof. In case of e.g., place surfaces, these surfaces may be parallel to the side exterior face of the legs, or sloped relative to the side exterior face of the legs.

Figure 36B:
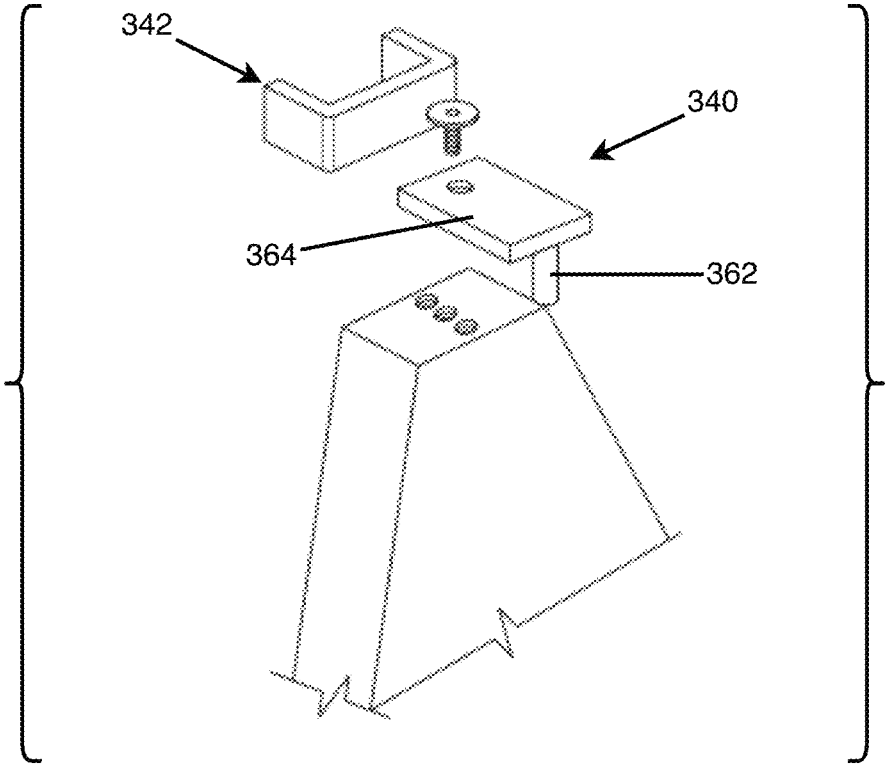

In FIG. 36B, in one embodiment the hook component 340 may feature a pin 362 part extending downward. The pin 362 part may be mounted to a plate part 364 secured to e.g., the top of a leg. According to an embodiment, the hook component 340 is rotatably mounted to the leg, being able to rotate between a frontmost angle and a rearmost angle to ease linking the chairs into an arc-shape chain.

Figure 36C:
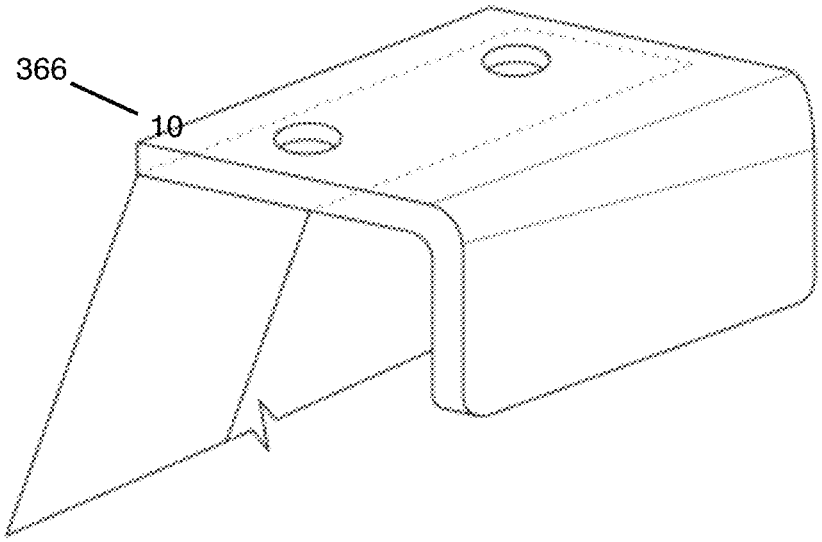

In FIG. 36C, in one embodiment, the hook component 340 is an unibody bracket 366 made of a bent plate. According to embodiments, the bracket 366 may be designed for the bent to be mounted parallel to the side exterior face of the leg, or slanted relative to the side exterior face of the leg such as limiting the positioning of the chairs of a chain substantially between e.g., a straight line and an arc-shapes lines having its center frontward, see e.g., chain of chairs of FIG. 37.

Figure 36D:
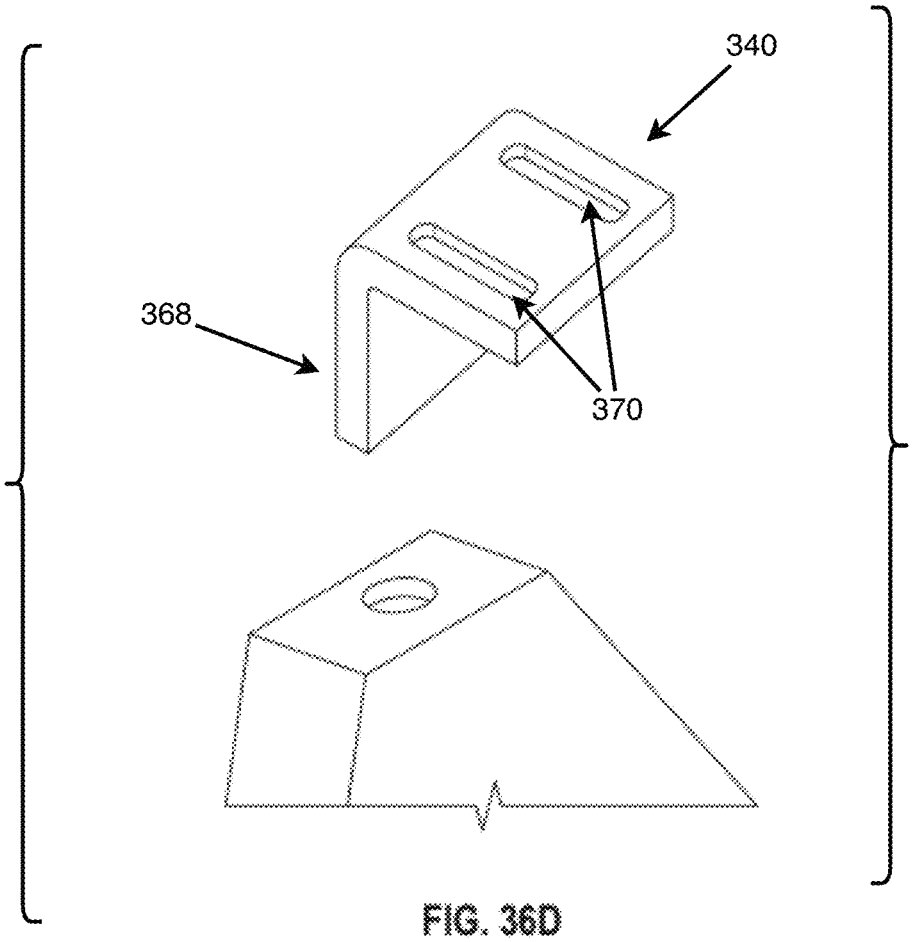

In FIG. 36D, in one embodiment, the hook component 340 may be slidingly mounted to a leg, such as being able to set the prong portion 368 more or less distant to the leg. Such solution may involve, as depicted, oblong securing holes 370 used to secure the hook component to a leg of the chair.

Figure 38A:
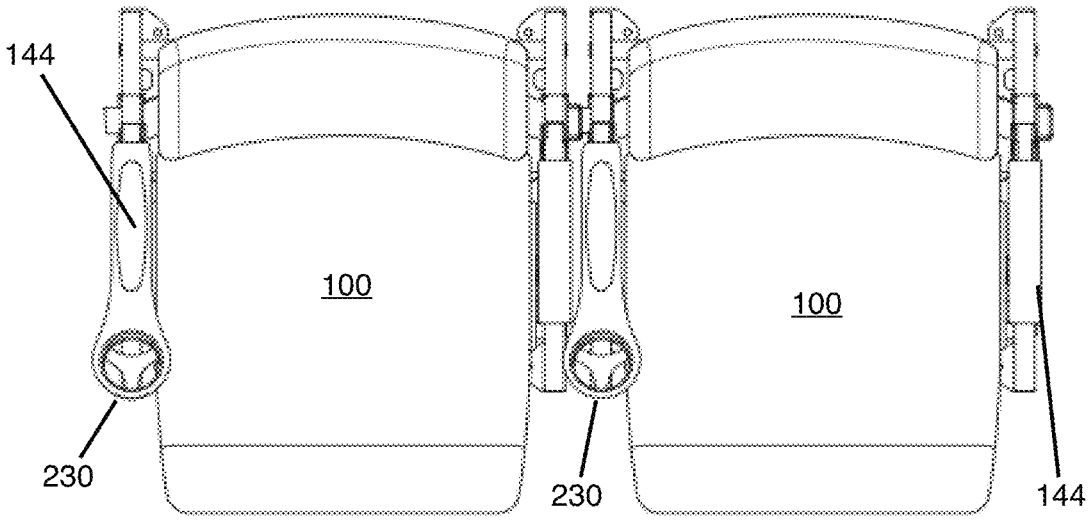
FIGS. 38A-38B are respectively a plan view and a front view of two chairs ganged in accordance with an embodiment.
Figure 38B:
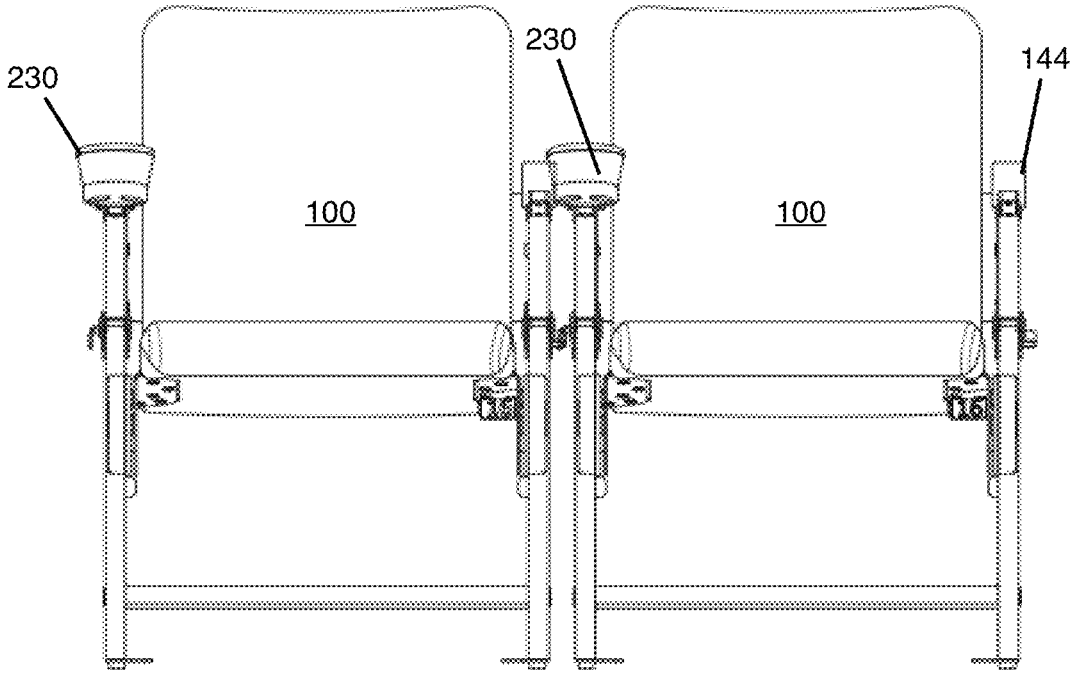

Referring to FIGS. 38A and 38B, chairs may be linked, or ganged, with or without accessories mounted thereto. FIGS. 38A and 38B shows two chairs 100 ganged while cup holders 230 mounted thereto. Chairs 100 of FIGS. 38A and 38B are mounted according to a straight-line configuration. The chair 100 depicted on the right has its hook component 342 engaged in the loop component 340 of the chair 100 depicted left. The space between the chained chairs 100 is thus bounded, as the angle the chairs 100 may adopt relative to each other.

It is worth noting that in view of no component of the chair extending sideways beyond the plane formed by the side outface of the legs, except the accessory, e.g., cup holders 320, the chairs 100 are not interfering with each other. And since the accessory extends frontwards relative to the armrest 144 it is mounted to, the accessory extends also generally in front of the armrest 144 of the neighboring chair. Thus, with the chairs 100 described, ganging chairs 100 does not rise challenges of chairs 100 having to be placed slightly in front of each other. For further clarity, ganging chairs corresponds to laterally assembling a plurality of chairs 100 together, whether in a temporary or permanent configurations, whether in straight line or with a curved as allowed by the securing elements between the chairs.

Referring now to e.g., FIG. 16 and to FIGS. 39A to 39E in view of FIG. 9 to FIG. 11, preferred solution to store the chairs of the present description consists in hanging them over a rack 180 with the legs extending upwards. Such solution, considering the chairs 100 comprising a counterweight, results in the seat 140 wobbling when turning upside down the chairs 100. Accordingly, it is useful that the chairs 100 comprise a solution to limit or at least mitigate that wobbling.

Depicted in FIG. 16, one embodiment encompasses the use of a tab 154 located on the side of the seat that becomes wedged between the legs when the legs are folded.

Figure 40:
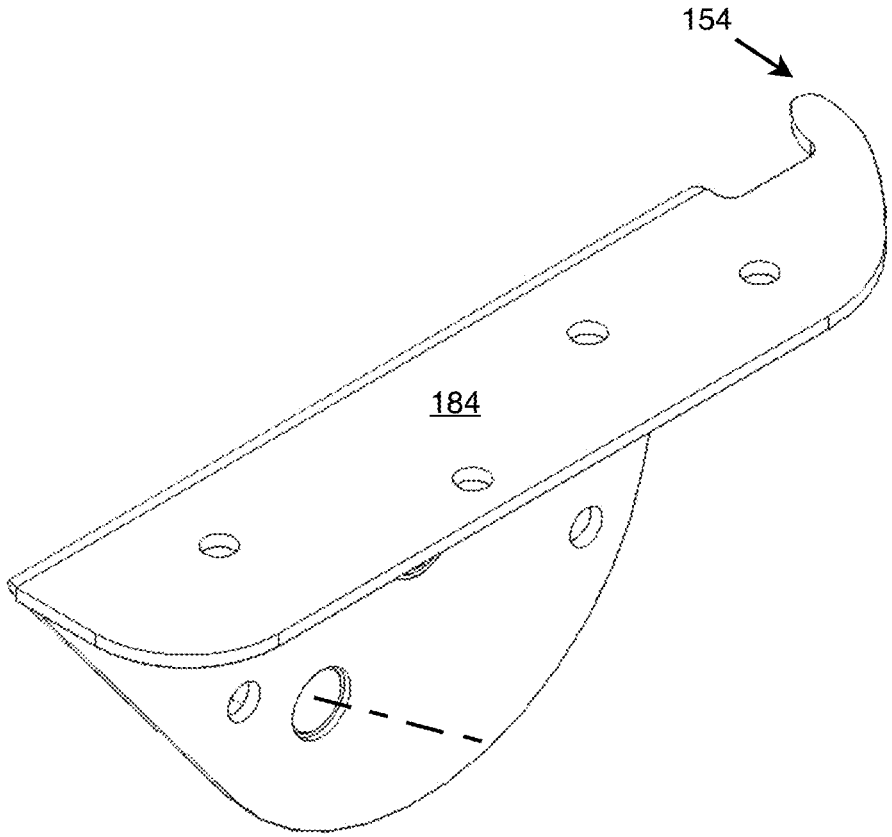
FIG. 40 is a perspective view of a seat bracket comprising a tab designed for holding the seat when legs of the chair are folded in accordance with an embodiment.

According to an embodiment depicted on FIG. 40, the tab 154 is integrated in the seat bracket 184 with the seat bracket 184 extending inside and rearward in the seat 140 with only the tab 154 exiting the seat 140 rearward to the pivot axis.

Figure 39A:
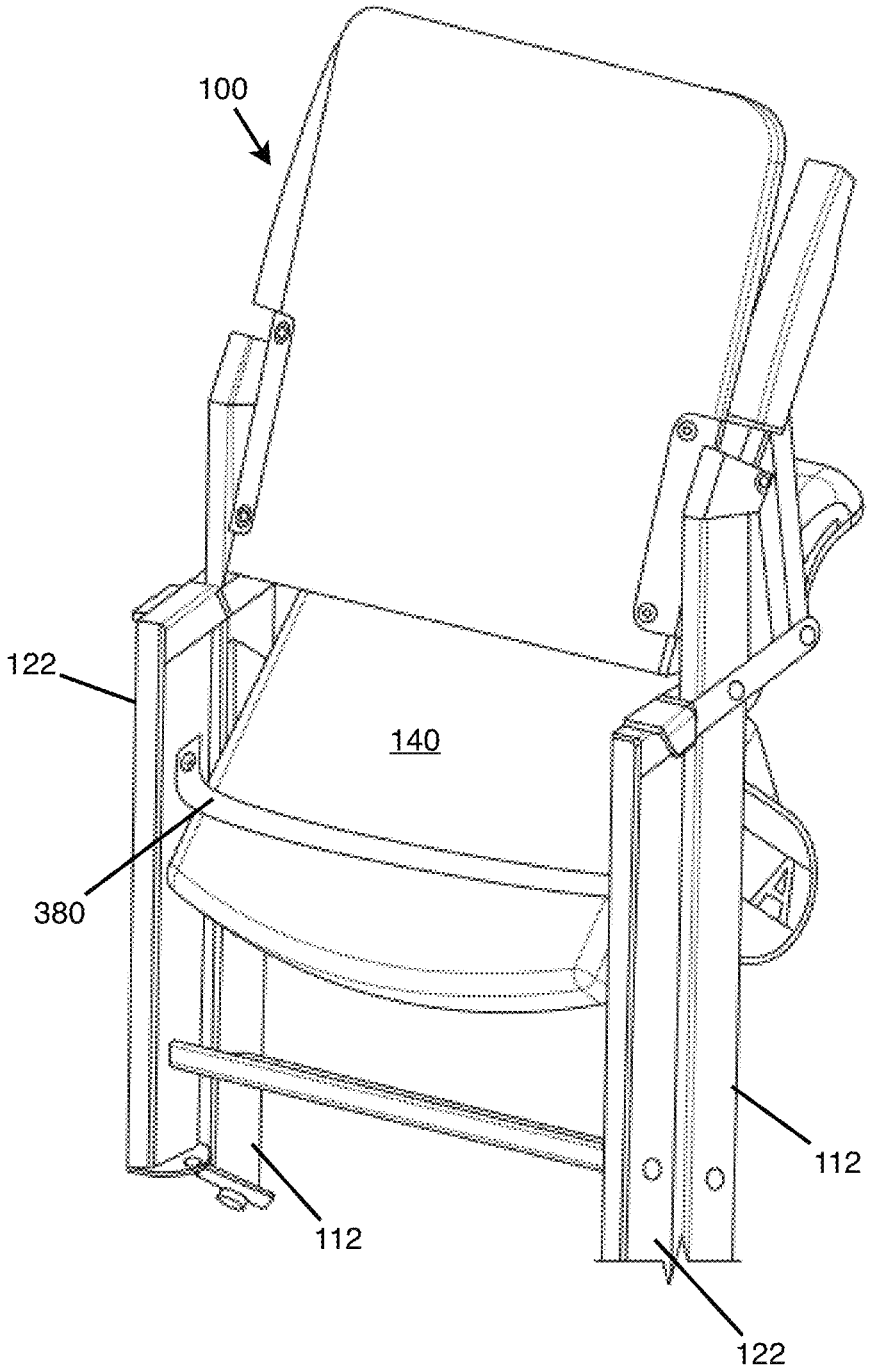
FIGS. 39A-39E are alternative solutions to hold the seat in the upright position regardless of the orientation of the chair, e.g., when hanging the chair.

FIG. 39A depicts an embodiment wherein a component, namely a strap 380, that extends from one rear leg 122 to the other and that pushes against the seat 140 when the legs 112, 122 are folded. Thereby, the strap 380 retains the seat 140 upright when folded.

Figure 39B:
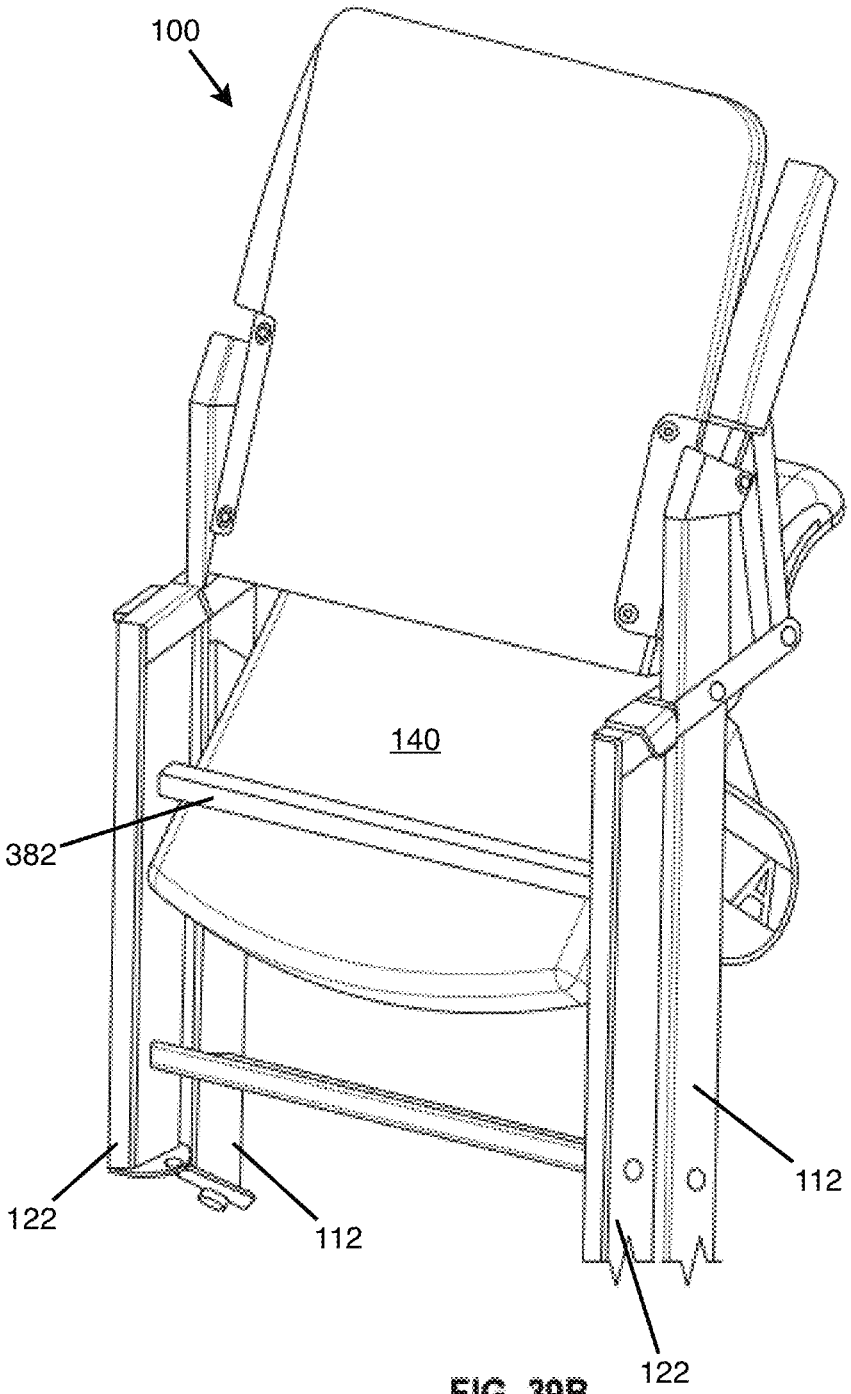

FIG. 39B depicts an embodiment wherein a bar 382 that is extending from one rear leg 122 to the other and that pushes against the seat 140, like the strap 380, when the legs 112, 122 are folded.

Figure 39C:
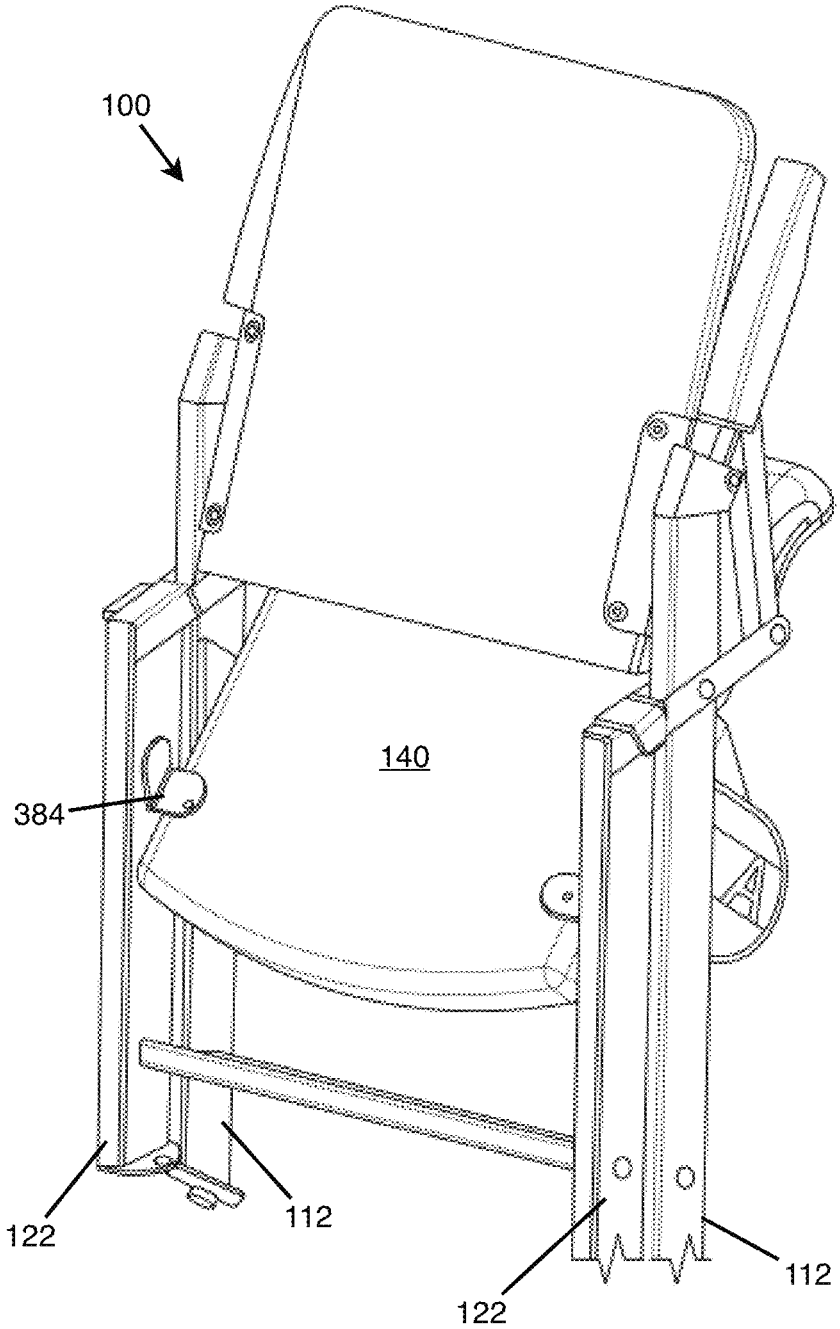

FIG. 39C depicts an embodiment wherein brackets 384 extend from the side inner face of the rear legs 122. These brackets 384 are designed to abut against the seat 140 to retain the seat 140 in its upright position when the legs 112, 122 are folded.

Figure 39D:
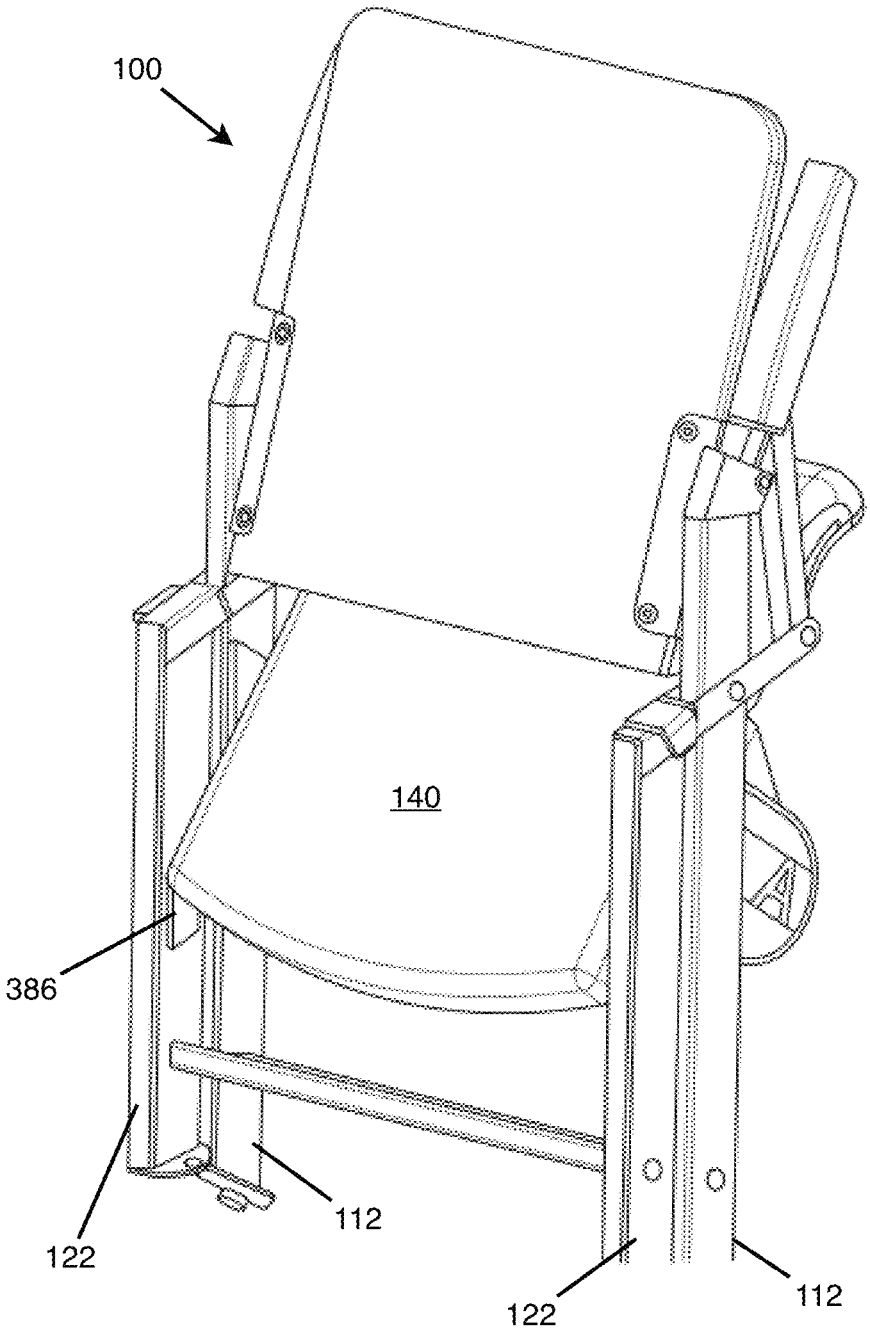
Figure 39E:
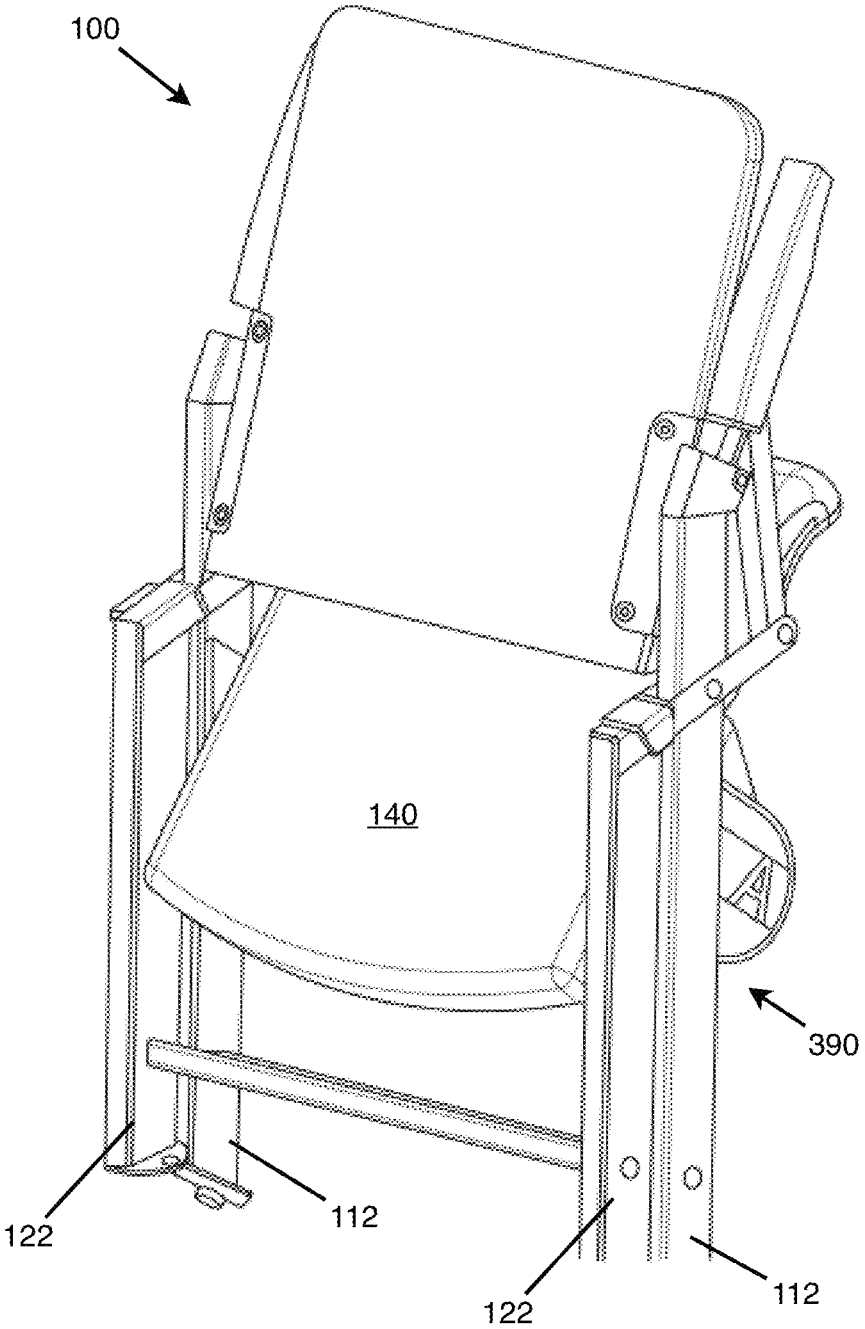

FIG. 39D depicts an embodiment wherein brackets 386 extend from the side inner face of the rear legs 122, These brackets 386 are designed to abut against the bottom face of the seat 140. These brackets 386, interfacing with the seat 140, are designed to hold the seat 140 in place. Such embodiments may involve damping components. Such embodiments may also involve magnet or physical components to exert the seat to remain abutting against the brackets 386 regardless of the orientation of the chair 100.

FIG. 39 depicts an alternative embodied wherein the locking mechanism 390 is embedded in component(s) of the chair 100, e.g., within the seat mounting assembly or within the seat.

Therethrough, the present contemplates various solutions to hold the seat 140 in its upright position when the legs 112, 122 are folded. Such a solution may involve physical interaction of some part of the seat 140 with a combination of the front legs 112 and the rear legs 122, or with components mounted to the rear legs 122. Alternatively, the solution may be embedded in the chair structure.

It is to be noted that the tabs 154 extending sideways from the seat 140 is advantageous over the other solutions, comprising one or more of the following:

a) It generates no contact or pressure over the cushion of the seat 140 which may generate premature wear.

b) It does not require additional parts since potentially integrated into the shape of one existing part of the seat 140 or into the seat bracket 184.

c) It forces the seat 140 to adopt the upright position in case the counterweight does not perform its function.

d) it does not create more areas that the user must take care to avoid when folding the chair 100 to avoid pinching their fingers.

e) dampers or cushions (when used) may be installed and replaced easily, without affecting its performance and with minimal efforts.

f) it does not require any additional action from the user than the one required to fold the chairs 100. It does not involve e.g., the operation of a locking mechanism or other device before folding the chair 100 or once the chair 100 is folded.

g) it involves substantially no increase in the weight of the chair 100.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A folding chair comprising:

a first leg assembly;

a second leg assembly rotatably mounted to the first leg assembly, the second leg assembly foldable between an unfolded configuration and a folded configuration in which the second leg assembly extends closer to the first leg assembly;

a backrest mounted to one of the leg assemblies;

a pair of seat mounting assemblies, each one of the seat mounting assemblies being mounted to one of the legs of one of the first leg assembly and the second leg assembly; and a seat mounted to the seat mounting assemblies, the seat, assembled to the seat mounting assemblies, being pivotable around a seat pivot axis, the seat being movable between a seating position and an upright position, the seat comprising a counterweight rearward to the seat pivot axis biasing the seat into the upright position, wherein at least one of the seat mounting assemblies comprises a first damping means damping pivotal motion of the seat when reaching the upright position.

2. The folding chair of claim 1, wherein the at least one of the seat mounting assemblies comprises a pin travelling in a slot, and the first damping means comprises a sleeve mounted to the pin that is damping an end of course of the pin into the slot.

3. The folding chair of claim 1, wherein the at least one of the seat mounting assemblies comprises a pin travelling in a slot, and the first damping means comprises a cushion mounted to one end of the slot.

4. The folding chair of claim 1, wherein the seat mounting assemblies comprise a plate having a shaft hole; and an arched slot having a center of curvature concentric to the shaft hole.

5. The folding chair of claim 4, wherein the seat mounting assemblies comprise a bracket coupled to the seat; a shaft extending from the bracket; and a pin extending from the bracket.

6. The folding chair of claim 5, wherein the plate extends parallel to the bracket.

7. The folding chair of claim 6, wherein the plate extends frontwards relative to the leg assemblies.

8. The folding chair of claim 7, wherein the seat mounting assemblies comprise a cap that hinders access to the plate from an opposed direction to the bracket.

9. The folding chair of claim 8, wherein the cap covers entirely the slot.

10. The folding chair of claim 1, further comprising a second damping means that is damping pivotal motion of the seat when reaching the seating position, wherein the first damping means provides more damping than the second damping means.

11. The folding chair of claim 1, wherein the first damping means consists of a sleeve mounted to a pin travelling in a slot between two end-of-course positions, and a cushion mounted to a first one of the end-of-course positions corresponding to the upright position of the seat, thereby providing damping in the seating position of the seat, and a greater damping in the upright position of the seat.

12. The folding chair of claim 1, wherein the seat mounting assemblies comprise a plate having a non-circular shaft hole allowing a shaft to move between aligned to the seat pivot axis and another seat pivot axis, and a slot having two end-of-course positions, wherein a first arched section of the slot is centered to the pivot axis, and a second section of the slot is centered to the other pivot axis.

13. A folding chair comprising:

a front leg assembly comprising two front legs;

a rear leg assembly comprising two rear legs, the rear legs being mounted to the front legs, the rear leg assembly foldable between an unfolded configuration and a folded configuration in which the rear leg assembly extends close to the front leg assembly;

a backrest mounted to the front leg assembly;

a first seat mounting assembly mounted a first one of the front legs;

a second seat mounting assembly mounted a second one of the front legs; and a seat mounted to the seat mounting assemblies, the seat being pivotable around a seat pivot axis, the seat being movable between a seating position and an upright position, the seat comprising a counterweight rearward to the seat pivot axis biasing the seat into the upright position, wherein at least one of the seat mounting assemblies comprises a first damping means that is damping pivotal motion of the seat when reaching the upright position.

14. The folding chair of claim 13, wherein each of the seat mounting assemblies comprises: a plate that is mounted to the corresponding front leg, the plate comprising two end-of-course positions; and a bracket that is mounted to the seat and rotatably coupled to the plate, the bracket comprising a pin travelling between the end-of-course positions when the seat rotates between the seating position and the upright position.

15. The folding chair of claim 14, wherein the pin follows a path between the two end-of-course positions, wherein the path is farther from the front leg than the pivot axis.

16. The folding chair of claim 15, wherein each one of the seat mounting assemblies comprises a cap that is mounted to the plate, the cap forming an enclosure to the path.

17. The folding chair of claim 15, wherein the bracket is forming an enclosure impeding access of foreign objects to the path from under the seat.

18. The folding chair of claim 13, wherein at least one of the seat mounting assemblies provides an intermediary position, wherein the seat is biased from the seating position towards the intermediary position, and wherein an external force must be exerted on the seat for the seat to travel beyond the intermediary position.

19. The folding chair of claim 13, wherein the counter-weight is enclosed in the seat.

20. The folding chair of claim 13, wherein the pivot axis is upfront and distant to the seat.

* * * * *